US011557246B2

(12) United States Patent
Xuan et al.

(10) Patent No.: US 11,557,246 B2
(45) Date of Patent: Jan. 17, 2023

(54) PIXEL CIRCUIT AND METHOD FOR CONTROLLING THE SAME, AND DISPLAY DEVICE

(71) Applicant: BOE TECHNOLOGY GROUP CO., LTD., Beijing (CN)

(72) Inventors: Minghua Xuan, Beijing (CN); Xue Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 17 days.

(21) Appl. No.: 17/419,162

(22) PCT Filed: Sep. 30, 2020

(86) PCT No.: PCT/CN2020/119501
§ 371 (c)(1),
(2) Date: Jun. 28, 2021

(87) PCT Pub. No.: WO2022/067705
PCT Pub. Date: Apr. 7, 2022

(65) Prior Publication Data
US 2022/0148493 A1 May 12, 2022

(51) Int. Cl.
*G09G 3/32* (2016.01)

(52) U.S. Cl.
CPC ..... *G09G 3/32* (2013.01); *G09G 2300/0426* (2013.01); *G09G 2310/061* (2013.01)

(58) Field of Classification Search
CPC ..... G09G 3/32; G09G 2310/08
See application file for complete search history.

(56) References Cited

U.S. PATENT DOCUMENTS

2010/0060557 A1* 3/2010 Hsu ..... G09G 3/3688 345/87
2010/0309174 A1 12/2010 Tomida et al.
2012/0105732 A1* 5/2012 Hsu ..... H04N 21/4436 348/730
2013/0083000 A1 4/2013 Toyomura et al.
(Continued)

FOREIGN PATENT DOCUMENTS

CN 101908309 A 12/2010
CN 103035188 A 4/2013
CN 110021263 A 7/2019
(Continued)

*Primary Examiner* — Andrew Sasinowski
(74) *Attorney, Agent, or Firm* — IP & T Group LLP

(57) ABSTRACT

A pixel circuit includes an input circuit and a time control circuit. The input circuit is configured to output a driving signal to an element to be driven, so that the element to be driven emits light. The time control circuit is coupled to the input circuit, and is configured to control a light-emitting duration of the element to be driven to be a first duration by controlling the input circuit in response to a first control signal provided by a first control signal terminal, and control the light-emitting duration to be a second duration by controlling the input circuit in response to a second control signal provided by a second control signal terminal and a third control signal provided by a third control signal terminal. The second duration is less than the first duration, and the second duration includes a plurality of interval time periods.

20 Claims, 12 Drawing Sheets

(56) References Cited

U.S. PATENT DOCUMENTS

2016/0284313 A1* 9/2016 Lin ..... G09G 5/18

FOREIGN PATENT DOCUMENTS

| | | | |
|---|---|---|---|
| CN | 110021264 | A | 7/2019 |
| CN | 110706652 | A | 1/2020 |
| JP | 2012-058351 | A | 3/2012 |
| WO | 2020/007024 | A1 | 1/2020 |
| WO | 2020/048075 | A1 | 3/2020 |

* cited by examiner

PIXEL CIRCUIT AND METHOD FOR CONTROLLING THE SAME, AND DISPLAY DEVICE

CROSS-REFERENCE TO RELATED APPLICATIONS

This application is a national phase entry under 35 USC 371 of International Patent Application No. PCT/CN2020/119501, filed on Sep. 30, 2020, which is incorporated herein by reference in its entirety.

TECHNICAL FIELD

The present disclosure relates to the field of display technologies, and in particular, to a pixel circuit and a method for controlling the same, and a display device.

BACKGROUND

Micro light-emitting diode (Micro LED) display devices and mini light-emitting diode (Mini LED) display devices have higher luminous efficiency and reliability, and lower power consumption than organic light-Emitting diode (OLED) display devices, and thus may become a mainstream of display products in the future. In the Micro LED display device and the Mini LED display device, pixel circuits are used to drive light-emitting diodes (LEDs) to emit light to achieve display. Therefore, a structure of the pixel circuit is very important for ensuring display effects of the Micro LED display device and the Mini LED display device.

SUMMARY

In one aspect, a pixel circuit is provided. The pixel circuit includes an input circuit and a time control circuit. The input circuit is configured to output a driving signal to an element to be driven, so that the element to be driven emits light. The time control circuit is coupled to the input circuit, and is configured to control a light-emitting duration of the element to be driven to be a first duration by controlling the input circuit in response to a first control signal provided by a first control signal terminal, and control the light-emitting duration of the element to be driven to be a second duration by controlling the input circuit in response to at least a second control signal provided by a second control signal terminal and a third control signal provided by a third control signal terminal. The second duration is less than the first duration, and the second duration includes a plurality of interval time periods.

In some embodiments, the time control circuit is configured to control the light-emitting duration of the element to be driven to be the second duration by controlling the input circuit in response to the first control signal, the second control signal and the third control signal.

In some embodiments, the time control circuit is configured to control the light-emitting duration of the element to be driven to be the second duration by controlling the input circuit in response to the second control signal, the third control signal and a fourth control signal provided by a fourth control signal terminal. Or the time control circuit is configured to control the light-emitting duration of the element to be driven to be the second duration by controlling the input circuit in response to the first control signal, the second control signal, the third control signal, and a fourth control signal provided by a fourth control signal terminal.

In some embodiments, the fourth control signal terminal is a gate signal terminal, and the gate signal terminal is coupled to the input circuit.

In some embodiments, the time control circuit includes a first time control sub-circuit and a second time control sub-circuit. The first time control sub-circuit is coupled to the first control signal terminal and a second node, and the second node is coupled to the input circuit. The first time control sub-circuit is configured to control the input circuit through the second node under control of the first control signal terminal, so that the light-emitting duration of the element to be driven is the first duration.

The second time control sub-circuit is coupled to the second control signal terminal, the third control signal terminal and the second node, and is configured to transmit the third control signal provided by the third control signal terminal to the second node under control of the second control signal terminal, and to control the input circuit through the second node, so that the light-emitting duration of the element to be driven is the second duration.

In some embodiments, the first time control sub-circuit includes a seventh transistor. A gate and a first electrode of the seventh transistor are coupled to the first control signal terminal, and a second electrode of the seventh transistor is coupled to the second node.

In some embodiments, the second time control sub-circuit includes an eighth transistor. A gate of the eighth transistor is coupled to the second control signal terminal, a first electrode of the eighth transistor is coupled to the third control signal terminal, and a second electrode of the eighth transistor is coupled to the second node.

In some embodiments, the second time control sub-circuit is further coupled to the first control signal terminal, and the second time control sub-circuit includes an eighth transistor and a tenth transistor. A gate of the eighth transistor is coupled to the second control signal terminal, and a first electrode of the eighth transistor is coupled to the third control signal terminal. A gate of the tenth transistor is coupled to the first control signal terminal, a first electrode of the tenth transistor is coupled to a second electrode of the eighth transistor, and a second electrode of the tenth transistor is coupled to the second node. A width-to-length ratio of the tenth transistor is greater than a width-to-length ratio of the seventh transistor.

In some embodiments, the width-to-length ratio of the tenth transistor is at least 2 times the width-to-length ratio of the seventh transistor.

In some embodiments, the second time control sub-circuit further includes a ninth transistor, and the gate of the eighth transistor is coupled to the second control signal terminal through the ninth transistor. A gate of the ninth transistor is coupled to a fourth control signal terminal, a first electrode of the ninth transistor is coupled to the second control signal terminal, and a second electrode of the ninth transistor is coupled to a third node.

In some embodiments, the second time control sub-circuit further includes a second capacitor, one end of the second capacitor is coupled to the third node, and another end of the second capacitor is coupled to a ground terminal.

In some embodiments, the time control circuit includes: a seventh transistor, an eighth transistor, a ninth transistor, a tenth transistor and a second capacitor.

A gate and a first electrode of the seventh transistor are coupled to the first control signal terminal, a second electrode of the seventh transistor is coupled to a second node, and the second node is coupled to the input circuit.

A gate of the eighth transistor is coupled to a third node, a first electrode of the eighth transistor is coupled to the third control signal terminal, and a second electrode of the eighth transistor is coupled to a first electrode of the tenth transistor.

A gate of the ninth transistor is coupled to a fourth control signal terminal, a first electrode of the ninth transistor is coupled to the second control signal terminal, and a second electrode of the ninth transistor is coupled to the third node.

A gate of the tenth transistor is coupled to the first control signal terminal, and a second electrode of the tenth transistor is coupled to the second node.

One end of the second capacitor is coupled to the third node, and another end of the second capacitor is coupled to a ground terminal.

In some embodiments, the input circuit includes a data writing sub-circuit coupled to a gate signal terminal, a data signal terminal and a first power supply voltage signal terminal, including a driving transistor, the data writing sub-circuit being configured to write a data signal provided by the data signal terminal into a gate of the driving transistor under control of the gate signal terminal, so that the driving transistor outputs the driving signal under control of a gate voltage and a source voltage thereof;

a light-emitting control sub-circuit coupled to the date writing sub-circuit and the time control circuit, and configured to control the light-emitting duration of the element to be driven that is driven by the driving transistor in the data writing sub-circuit according to a signal transmitted by the time control circuit.

In some embodiments, the data writing sub-circuit includes a third transistor, a fifth transistor and a first capacitor, and the third transistor is the driving transistor. A gate of the third transistor is coupled to a first node, and a first electrode of the third transistor is coupled to the first power supply voltage signal terminal. A gate of the fifth transistor is coupled to the gate signal terminal, a first electrode of the fifth transistor is coupled to the data signal terminal, and a second electrode of the fifth transistor is coupled to the first node. One end of the first capacitor is coupled to the first node, and another end of the first capacitor is coupled to the first power supply voltage signal terminal.

The light-emitting control sub-circuit includes a sixth transistor. A gate of the sixth transistor is coupled to the time control circuit, a first electrode of the sixth transistor is coupled to a second electrode of the third transistor, and a second electrode of the sixth transistor is coupled to an anode of the element to be driven.

In some embodiments, the data writing sub-circuit includes: a second transistor, a third transistor, a fifth transistor and a first capacitor, and the third transistor is the driving transistor. A gate of the second transistor is coupled to the gate signal terminal, a first electrode of the second transistor is coupled to a second electrode of the third transistor, and a second electrode of the second transistor is coupled to a first node. A gate of the third transistor is coupled to the first node, and a first electrode of the third transistor is coupled to the first power supply voltage signal terminal. A gate of the fifth transistor is coupled to the gate signal terminal, a first electrode of the fifth transistor is coupled to the data signal terminal, and a second electrode of the fifth transistor is coupled to the first electrode of the third transistor. One end of the first capacitor is coupled to the first node, and another end of the first capacitor is coupled to the first power supply voltage signal terminal.

The light-emitting control sub-circuit includes a sixth transistor. A gate of the sixth transistor is coupled to the time control circuit, a first electrode of the sixth transistor is coupled to the second electrode of the third transistor, and a second electrode of the sixth transistor is coupled to an anode of the element to be driven.

In some embodiments, the light-emitting control sub-circuit further includes a fourth transistor, and the first electrode of the third transistor is coupled to the first power supply voltage signal terminal through the fourth transistor. A gate of the fourth transistor is coupled to a light-emitting control signal terminal, a first electrode of the fourth transistor is coupled to the first power supply voltage signal terminal, and a second electrode of the fourth transistor is coupled to the first electrode of the third transistor.

In some embodiments, the input circuit further includes a reset sub-circuit. The reset sub-circuit is coupled to a reset signal terminal and an initialization signal terminal, and is configured to reset the driving transistor or reset the driving transistor and the element to be driven through an initialization signal provided by the initialization signal terminal under control of the reset signal terminal.

In some other embodiments, the reset sub-circuit is coupled to a reset signal terminal, the gate signal terminal and an initialization signal terminal, and is configured to reset the driving transistor under control of the reset signal terminal, and to reset the element D to be driven under control of the gate signal terminal.

In some embodiments, the reset sub-circuit includes a first transistor. A gate of the first transistor is coupled to the reset signal terminal, a first electrode of the first transistor is coupled to the initialization signal terminal, and a second electrode of the first transistor is coupled to the gate of the driving transistor.

In some other embodiments, the reset sub-circuit includes a first transistor and an eleventh transistor. A gate of the first transistor is coupled to the reset signal terminal, a first electrode of the first transistor is coupled to the initialization signal terminal, and a second electrode of the first transistor is coupled to the gate of the driving transistor. A gate of the eleventh transistor is coupled to the reset signal terminal or the gate signal terminal, a first electrode of the eleventh transistor is coupled to the initialization signal terminal, and a second electrode of the eleventh transistor is coupled to the anode of the element to be driven.

In another aspect, a display device is provided. The display device includes the pixel circuit as described in any of the above embodiments.

In yet another aspect, a method for controlling the pixel circuit is provided, and the method includes at least a data writing phase and a light-emitting phase.

In the data writing phase, a data signal is written into the input circuit, so that the input circuit outputs the driving signal in the light-emitting phase, and the driving signal is configured to drive an element to be driven to emit light.

In the light-emitting phase, the time control circuit controls the light-emitting duration of the element to be driven to be the first duration by controlling the input circuit in response to the first control signal provided by the first control signal terminal.

Or the time control circuit controls the light-emitting duration of the element to be driven to be the second duration by controlling the input circuit in response to at least the second control signal provided by the second control signal terminal and the third control signal provided by the third control signal terminal. The third control signal is a square wave signal, the second duration is less than the first duration, and the second duration includes the plurality of interval time periods.

In some embodiments, the time control circuit controls the light-emitting duration of the element to be driven to be the second duration by controlling the input circuit in response to the first control signal, the second control signal and the third control signal.

In some embodiments, the time control circuit controls the light-emitting duration of the element to be driven to be the second duration by controlling the input circuit in response to the second control signal, the third control signal and a fourth control signal provided by a fourth control signal terminal.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on actual sizes of products, actual processes of methods and actual timings of signals involved in the embodiments of the present disclosure.

DETAILED DESCRIPTION

Figure 1:
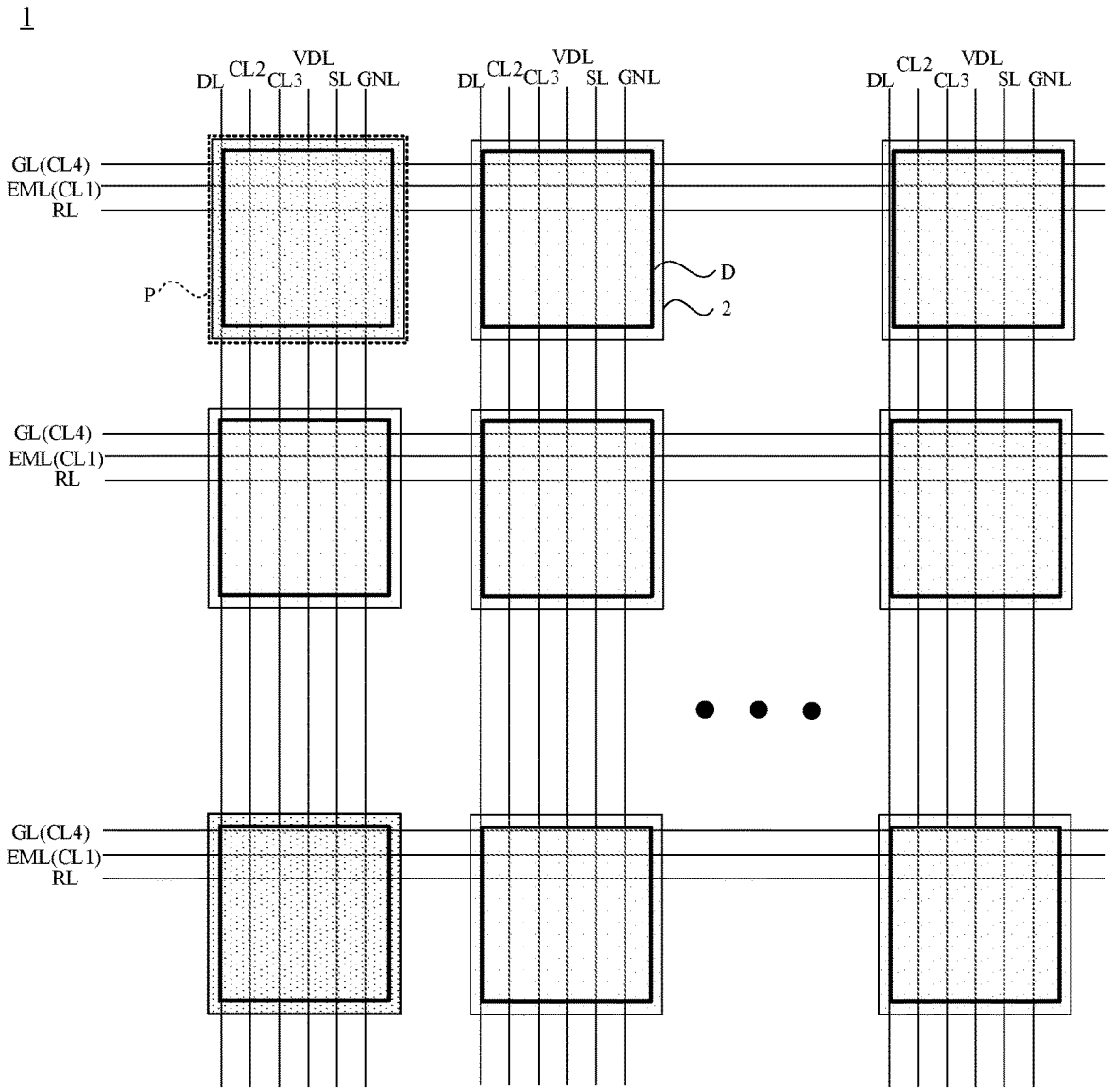
FIG. 1 is a structural diagram of a display panel, in accordance with some embodiments of the present disclosure.

Technical solutions in some embodiments of the present disclosure will be described clearly and completely below with reference to the accompanying drawings. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive meaning, i.e., "included, but not limited to." In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined with "first" and "second" may explicitly or implicitly include one or more of the features. In the description of the embodiments of the present disclosure, "a plurality of/the plurality of" means two or more unless otherwise specified.

In the description of some embodiments, the terms such as "coupled" and "connected" and their derivatives may be used. For example, the term "connected" may be used in the description of some embodiments to indicate that two or more elements are in direct physical or electrical contact with each other. For another example, the term "coupled" may be used in the description of some embodiments to indicate that two or more elements are in direct physical or electrical contact. However, the term "coupled" or "communicatively coupled" may also mean that two or more elements are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C.

The phrase "A and/or B" includes the following three combinations: only A, only B, and a combination of A and B.

As used herein, the term "if" is optionally construed as "when" or "in a case where" or "in response to determining" or "in response to detecting", depending on the context. Similarly, the phrase "if it is determined" or "if [a stated condition or event] is detected" is optionally construed as "in a case where it is determined" or "in response to determining" or "in a case where [the stated condition or event] is detected" or "in response to detecting [the stated condition or event]", depending on the context.

The use of the phrase "applicable to" or "configured to" herein means an open and inclusive meaning, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values other than those stated.

The term "about" or "approximately" as used herein includes a stated value and an average value within an acceptable range of deviation of a particular value. The acceptable range of deviation is determined by a person of ordinary skill in the art in view of measurement in question and errors associated with a particular amount of measurement (i.e., the limitations of the measurement system).

As used herein, the same reference numeral denote both corresponding signal terminal and corresponding signal.

In the field of display technologies, Micro LED display devices and Mini LED display devices have the advantages of high brightness and wide color gamut, and thus will be more and more widely applied in the display field in the future.

Referring to FIG. 1, the Micro LED display device and the Mini LED display device each include, for example, a display panel 1. The display panel 1 includes a plurality of sub-pixels P and a plurality of signal lines, and each sub-pixel P is provided with a pixel circuit 2 and an element D to be driven coupled to the pixel circuit 2. The plurality of signal lines are configured to provide various signals to the pixel circuit 2 to be used by the pixel circuit 2. The element D to be driven is, for example, a current-type element D to be driven. Further, the element D to be driven may be a current-type light-emitting diode, such as a micro light-emitting diode (Micro LED), a mini light-emitting diode (Mini LED), an organic light-emitting diode (OLED), or a quantum dot light-emitting diode (QLDE). In this case, a light-emitting duration of the element D to be driven described hereinafter may be understood as a working duration of the element D to be driven; that the element D to be driven is working may be understood to be that the element D to be driven is emitting light and is in a bright state; and that the element D to be driven is not working may be understood to be that the element D to be driven is not emitting light and is in a dark state. A first electrode and a second electrode of the element D to be driven may be understood as an anode and a cathode of the light-emitting diode; and outputting a driving signal to the element D to be driven may be understood as outputting a driving current Id to the element D to be driven.

For example, referring to FIG. 1, the plurality of signal lines include, for example, gate lines GL, first control signal lines CL1, reset signal lines RL, data signal lines DL, second control signal lines CL2, third control signal lines CL3, fourth control signal lines CL4, initialization signal lines SL, first power supply voltage signal lines VDL, and ground lines GNL. The gate line GL may also be used as the fourth control signal line CL4, and light-emitting control signal lines EML may also be used as the first control signal lines CL1. These signal lines are coupled to corresponding signal terminals in the pixel circuits 2, and various signals are provided to the pixel circuits 2 through the signal terminals.

Referring to FIG. 1, pixel circuits 2 in the same row are coupled to the same gate line GL (fourth control signal line CL4), first control signal line CL1 (light-emitting control signal line EML), and reset signal line RL.

Pixel circuits 2 in the same column are coupled to the same data signal line DL, second control signal line CL2, third control signal line CL3, initialization signal line SL, first power supply voltage signal line VDL, and ground line GNL.

Figure 2A:
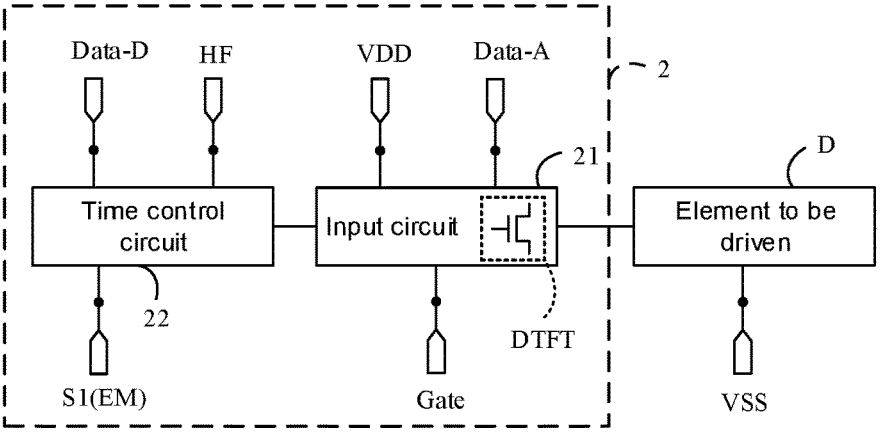
FIG. 2A is a structural diagram of a pixel circuit, in accordance with some embodiments of the present disclosure.
Figure 2B:
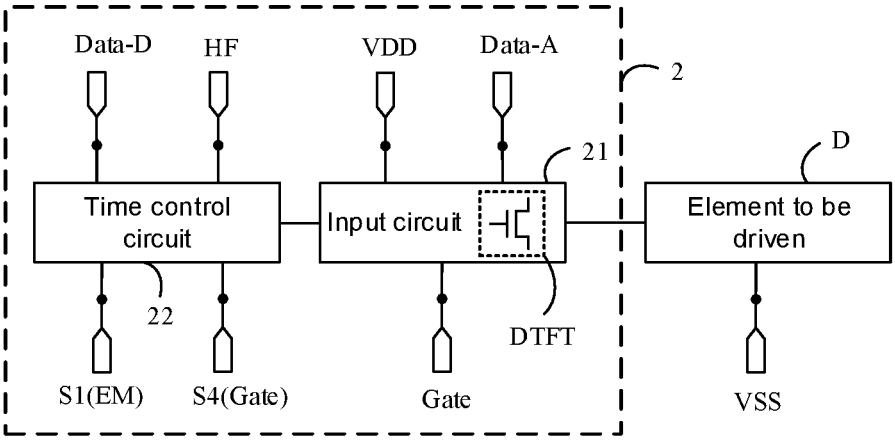
FIG. 2B is a structural diagram of another pixel circuit, in accordance with some embodiments of the present disclosure.
Figure 2C:
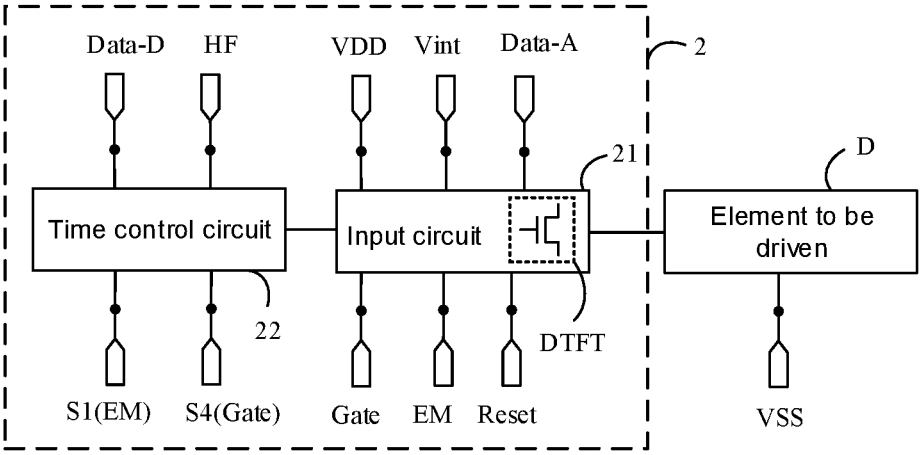
FIG. 2C is a structural diagram of yet another pixel circuit, in accordance with some embodiments of the present disclosure.

Referring to FIGS. 2A to 2C, some embodiments of the present disclosure provide a pixel circuit 2, including an input circuit 21 and a time control circuit 22.

The input circuit 21 is configured to output a driving signal to the element D to be driven, so that the element D to be driven emits light.

For example, the input circuit 21 includes a driving transistor (e.g., driving thin film transistor) DTFT. The input circuit 21 is configured to, for example, write a data signal provided by a data signal terminal Data-A into a gate of the driving transistor DTFT in response to a gate signal provided by a gate signal terminal Gate, so that the driving transistor DTFT outputs the driving signal for driving the element D to be driven to emit light according to a gate voltage and a source voltage thereof.

In some embodiments, the driving transistor DTFT is, for example, a P-type or N-type metal-oxide-semiconductor (MOS) transistor, or a P-type or N-type thin film transistor. The driving transistor DTFT includes, for example, the gate, a first electrode and a second electrode. The first electrode and the second electrode are, for example, a source and a drain. The driving signal output by the driving transistor DTFT is, for example, a driving current Id, and Id is equal to a product of K and a square of a difference between Vgs and Vth ($Id=K\times(Vgs-Vth)^2$. Where K is a constant, Vgs is a difference between the gate voltage and the source voltage of the driving transistor DTFT, i.e., $Vgs=Vg-Vs$. Vg is the gate voltage of the driving transistor DTFT, Vs is the source voltage of the driving transistor DTFT, and Vth is a threshold voltage of the driving transistor DTFT.

Since brightness of the element D to be driven when emitting light is related to the light-emitting duration and the driving current Id thereof, the brightness of the element D to be driven may be controlled by adjusting the light-emitting duration and/or the driving current Id thereof. For example, if driving currents Id of two elements D to be driven are the same, and light-emitting durations thereof are different, brightnesses displayed by the two elements D to be driven are different; if driving currents Id of two elements D to be driven are different, and light-emitting durations thereof are the same, brightnesses displayed by the two elements D to be driven are also different; if driving currents Id and light-emitting durations of two elements D to be driven are both different, it needs to be analyzed specifically whether brightnesses displayed by the two elements D to be driven are the same.

The time control circuit 22 is coupled to the input circuit 21, and is configured to: control the light-emitting duration of the element D to be driven to be a first duration T1 by controlling the input circuit 21 in response to a first control signal provided by a first control signal terminal S1; and control the light-emitting duration of the element D to be driven to be a second duration T2 by controlling the input circuit 21 in response to a second control signal provided by a second control signal terminal Data-D and a third control signal provided by a third control signal terminal HF. The second duration T2 is less than the first duration T1, and the second duration T2 is equal to a sum of a plurality of interval time periods t'. A length of the time period t' may be adjusted by adjusting a duty cycle of the third control signal HF.

For example, the first control signal is a scanning signal, and a light-emitting control signal may be used as the first control signal.

Since the driving signal capable of causing the element D to be driven to emit light is output by the input circuit 21, the time control circuit 22 may control the light-emitting duration of the element D to be driven by controlling the time during which the input circuit 21 outputs the driving signal to the element D to be driven. In this process, it can be understood that the time control circuit 22 realizes the control of the light-emitting duration of the element D to be driven by means of indirect control.

For example, the first duration T1 is continuous. That is, the first duration T1 only includes one time period. The second duration T2 is discontinuous. That is, the second duration T2 includes the plurality of interval time periods t', and the time between two adjacent time periods t' is non-working time of the element D to be driven, that is, the element D to be driven does not emit light during the time.

For example, referring to FIG. 2A, which is a structural diagram of the pixel circuit 2 and the element D to be driven, in a process where the input circuit 21 outputs the driving signal, if the time control circuit 22 receives the first control signal, the time control circuit 22 controls the light-emitting duration of the element D to be driven to be the first duration T1 by controlling the input circuit 21; if the time control circuit 22 receives the second control signal and the third control signal, the time control circuit 22 controls the light-emitting duration of the element D to be driven to be the second duration T2 by controlling the input circuit 21, and the second duration T2 includes the plurality of time periods t'. In this way, the time control circuit 22 may control the light-emitting duration of the element D to be driven by controlling the time during which the input circuit 21 outputs the driving signal to the element D to be driven according to the first control signal, the second control signal and the third control signal.

Based on the above, before the display device displays an image, a driving chip may analyze the image to be displayed first, so as to obtain a gray scale of the element D to be driven in each sub-pixel P in advance. Therefore, when the image is displayed, the driving chip may provide a corresponding data signal, first control signal, second control signal and third control signal to the pixel circuit 2 according to the gray scale corresponding to the element D to be driven, so as to control the brightness of the element D to be driven. Gray scales are obtained by dividing brightness between the maximum brightness and the minimum brightness into several parts. That is, magnitudes of the gray scales are in one-to-one correspondence with brightnesses. The higher the gray scale is, the brighter the brightness is, and thus the gray scale may be used to measure the brightness.

For example, when the element D to be driven needs to display a medium gray scale and display a high gray scale, the driving chip provides the first control signal to the element D to be driven to control the light-emitting duration of the element D to be driven to be the first duration T1 through the input circuit 21; when the element D to be driven needs to display a low gray scale, the driving chip provides the second control signal and the third control signal to the element D to be driven to control the light-emitting duration of the element D to be driven to be the second duration T2.

Since the first duration T1 is greater than the second duration T2, when the medium gray scale or the high gray scale is displayed, a longer light-emitting duration and a smaller driving current Id are adopted in the embodiments of the present disclosure to reduce the power consumption of the display panel 1 and protect the performance of the driving transistor DTFT; and when the low gray scale is displayed, a larger driving current Id and a shorter light-emitting duration are adopted in the embodiments of the present disclosure to ensure the stable operation of the element D to be driven.

It will be noted that the driving current Id adopted when the medium gray scale is displayed and the driving current Id adopted when the high gray scale is displayed are necessarily greater than the driving current Id adopted when the low gray scale is displayed. In the above description, the larger driving current Id and the smaller driving current Id are respectively compared on a premise of displaying the low gray scale simultaneously and on a premise of displaying the medium gray scale and the high gray scale simultaneously, but are not compared on a premise of displaying the low gray scale and displaying the medium gray scale and the high gray scale simultaneously. By setting preset values of the low gray scale, the medium gray scale and the high gray scale in the driving chip in advance, and comparing any gray scale with the preset values, a range to which the gray scale belongs may be determined, so as to ensure that the driving chip is able to determine which one of the low gray scale, the medium gray scale and the high gray scale the gray scale belongs to, and then the driving chip selects to provide the element D to be driven with the first control signal, or the second control signal and the third control signal.

For example, a gray scale range that the element D to be driven may display is 0 to 255. When a gray scale belongs to, for example, 0 to 30, the gray scale is the low gray scale; when a gray scale belongs to, for example, 31 to 170, the gray scale is the medium gray scale; when a gray scale belongs to, for example, 171 to 255, the gray scale is the high gray scale. It can be understood that, a value range of the data signal provided by the data signal terminal Data-A should enable the element D to be driven to work in a range with high luminous efficiency, good color coordinate uniformity and stable light-emitting dominant wavelength, and thus the data signal provided by the data signal terminal Data-A when the element D to be driven displays the medium scale and the high gray scale may have the same value range as the data signal provided by the data signal terminal Data-A when the element D to be driven displays the low gray scale.

On this basis, when a gray scale to be displayed by the element D to be driven belongs to the medium gray scale or the high gray scale, the time control circuit 22 controls the time during which the input circuit 21 outputs the driving signal to the element D to be driven to be the first duration T1 in response to the first control signal; when a gray scale to be displayed by the element D to be driven belongs to the low gray scale, the time control circuit 22 controls the time during which the input circuit 21 outputs the driving signal to the element D to be driven to be the second duration T2 in response to the second control signal and the third control signal. In this process, a direct object of the time control circuit 22 is the input circuit 21, but an ultimate goal is to control the element D to be driven to have different light-emitting durations at different gray scales, and thus the time control circuit 22 controls the element D to be driven indirectly.

Figure 3A:
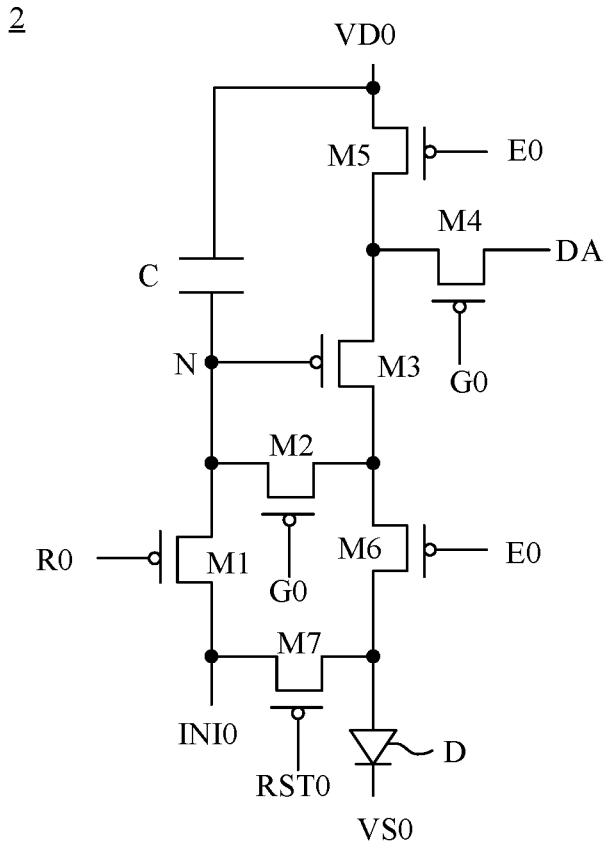
FIG. 3A is a structural diagram of a pixel circuit in the related art.

In the related art, referring to FIG. 3A, the pixel circuit 2 includes a transistor M1, a transistor M2, a transistor M3, a transistor M4, a transistor M5, a transistor M6, a transistor M7 and a capacitor C, and the transistor M3 is a driving transistor.

A gate of the transistor M1 is coupled to a reset signal terminal R0, a first electrode of the transistor M1 is coupled to an initialization signal terminal INI0, and a second electrode of the transistor M1 is coupled to a node N.

A gate of the transistor M2 is coupled to a gate signal terminal G0, a first electrode of the transistor M2 is coupled to a second electrode of the transistor M3, and a second electrode of the transistor M2 is coupled to the node N.

A gate of the transistor M3 is coupled to the node N, a first electrode of the transistor M3 is coupled to a second electrode of the transistor M4, and a second electrode of the transistor M3 is coupled to a first electrode of the transistor M6.

A gate of the transistor M4 is coupled to the gate signal terminal G0, and a first electrode of the transistor M4 is coupled to a data signal terminal DA.

A gate of the transistor M5 is coupled to a light-emitting control signal terminal E0, a first electrode of the transistor M5 is coupled to a first power supply voltage signal terminal VD0, and a second electrode of the transistor M5 is coupled to the first electrode of the transistor M3.

A gate of the transistor M6 is coupled to the light-emitting control signal terminal E0, and a second electrode of the transistor M6 is coupled to an anode of an element D to be driven.

A gate of the transistor M7 is coupled to the reset signal terminal RST0, a first electrode of the transistor M7 is coupled to the initialization signal terminal INI0, and a second electrode of the transistor M7 is coupled to the anode of the element D to be driven.

One end of the capacitor C is coupled to the node N, and the other end of the capacitor C is coupled to the first power supply voltage signal terminal VD0. A cathode of the element D to be driven is coupled to a second power supply voltage signal terminal VS0.

The time (frame period) for the display panel 1 to display a frame of image is related to a refresh frequency of the display panel 1. For example, when the refresh frequency of the display panel 1 is 60 Hz, the time for displaying the frame of image is 1/60 s. The display panel 1 adopts a line scanning technology, and thus the total time consumed from a beginning of light emission of the elements D to be driven that are driven by the pixel circuits 2 in the first row of the display panel 1 to an end of light emission of the elements D to be driven that are driven by the pixel circuits 2 in the last row of the display panel 1 is 1/60 s during display. Therefore, the time allocated to each row of pixel circuits 2 is related to the number of rows of the display panel 1. For convenience of description, hereinafter, an entire process in which the pixel circuits 2 drive the elements D to be driven to emit light in the frame of image is referred to as a driving period. When the display panel 1 drives the elements D to be driven in a progressive scanning mode, it can be understood that a duration of the driving period is less than a duration of the frame of image. However, the present disclosure is not limited thereto.

Figure 3B:
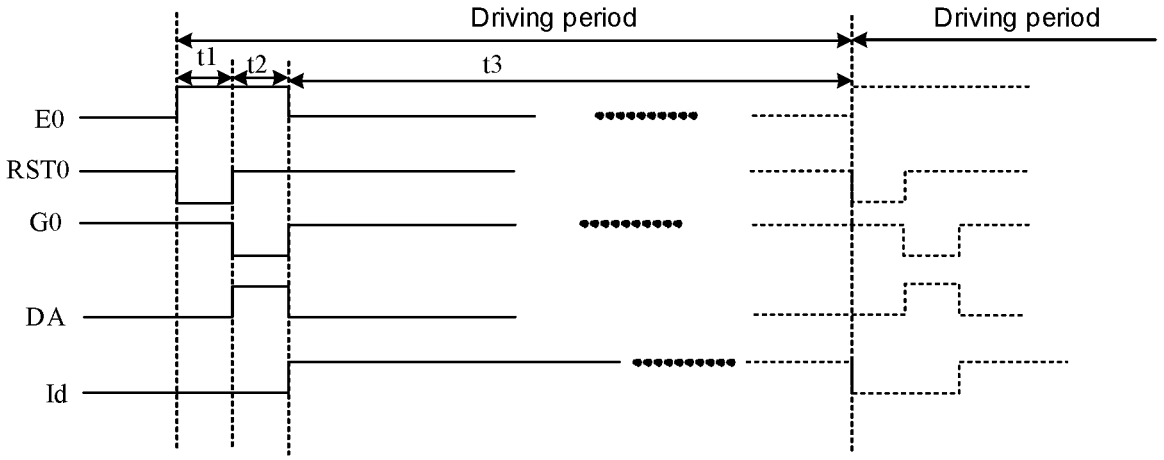
FIG. 3B is a timing diagram of a pixel circuit in the related art when displaying a medium gray scale and a high gray scale.
Figure 3C:
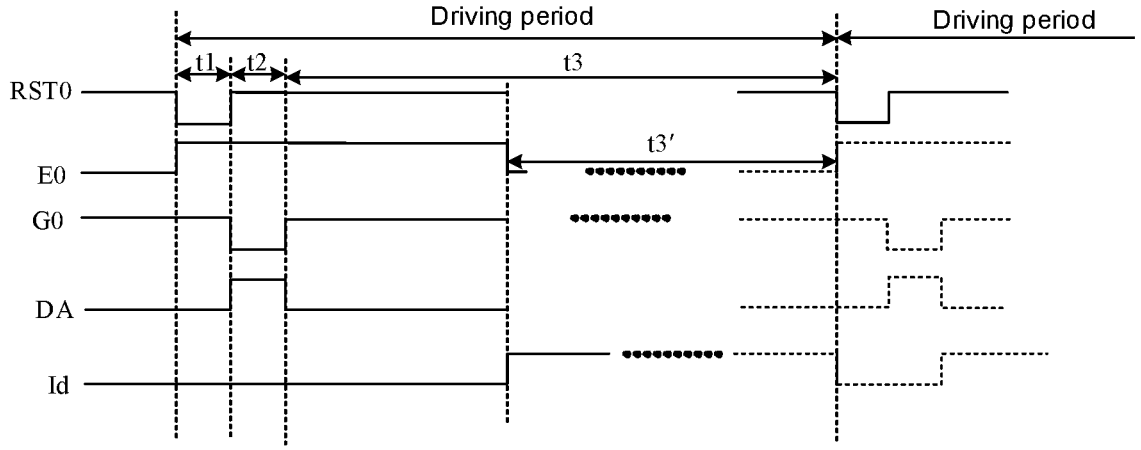
FIG. 3C is a timing diagram of a pixel circuit in the related art when displaying a low gray scale.

For the structure in FIG. 3A, with reference to FIGS. 3B and 3C, a working process of the pixel circuit 2 in the driving period includes, for example, the following phases.

In a reset phase t1, under control of a reset signal provided by the reset signal terminal RST0, the transistor M1 and the transistor M7 are turned on, and an initialization signal provided by the initialization signal terminal INI0 is transmitted to the gate of the driving transistor M3 and the anode of the element D to be driven for resetting.

In a data writing phase t2, under control of a gate signal provided by the gate signal terminal G0, the transistor M2 and the transistor M4 are turned on, and a data signal provided by the data signal terminal DA is transmitted to the gate of the transistor M3 through the transistor M4, the transistor M3 and the transistor M2, and the capacitor C is charged. In this case, the transistor M3 is in a self-saturation state. That is, a difference between a gate voltage Vg and a source (e.g., the first electrode) voltage Vs of the transistor M3 is equal to a threshold voltage Vth thereof.

In a light-emitting phase t3, under control of a light-emitting control signal provided by the light-emitting control signal terminal E0, the transistor M5 and the transistor M6 are turned on, and the capacitor C starts to discharge, so that the gate voltage of the transistor M3 is further raised, and the transistor M3 is turned on to output a driving signal to the element D to be driven, and the element D to be driven starts to emit light. The driving signal is, for example, a driving current Id, and a magnitude of the driving current Id is related to the gate voltage Vg of the transistor M3 and a first power supply voltage $V_{DD}$ provided by the first power supply voltage signal terminal VD0.

Referring to FIG. 3B, which is a timing diagram of the pixel circuit 2 in the related art when displaying a medium gray scale and a high gray scale, in the figure, in the light-emitting phase t3, the light-emitting control signal provided by the light-emitting control signal terminal E0 is an effective signal (at a low level). Therefore, a light-emitting duration of the element D to be driven is equal to a duration of the light-emitting phase t3, for example, 1000 microseconds (μs). In this process, since the element D to be driven needs to display the medium gray scale and the high gray scale, and its brightness is relatively high, the element D to be driven performs display by using a relatively small driving current Id and a relatively long light-emitting duration.

Referring to FIG. 3C, which is a timing diagram of the pixel circuit 2 in the related art when displaying a low gray scale, in the figure, in the light-emitting phase t3, the light-emitting control signal provided by the light-emitting control signal terminal E0 includes both an effective signal (at a low level) and an ineffective signal (at a high level). Therefore, the light-emitting duration of the element D to be driven is less than the duration of the light-emitting phase t3, and is equal to a duration t3' of the effective signal of the light-emitting control signal, for example, 10 microseconds (the duration of the light-emitting phase t3 is, for example, 1000 microseconds). In this process, since the element D to be driven needs to display the low gray scale, and its brightness is relatively small, the pixel circuit 2 performs display by using a relatively large driving current Id and a relatively short light-emitting duration.

It can be understood by those skilled in the art that, when the display panel 1 is displaying images, a display time allocated to each frame of image is a reciprocal of the refresh frequency of the display panel 1. In the frame of image, each element D to be driven emits light only in the time period of the light-emitting phase t3, whereas in the reset phase t1 and the data writing phase t2, the element D to be driven does not emit light (that is, the element D to be driven is in a dark state). However, the duration of the light-emitting phase t3 is not necessarily equal to the light-emitting duration. In FIG. 3C, the light-emitting duration (i.e., t3') only occupies a period of time in the light-emitting phase t3. During the remaining time in the light-emitting phase t3, the element D to be driven is in the dark state. As a result, the time during which the element D to be driven is in the continuous dark state (the time during which the element D to be driven does not emit light in the reset phase t1, the data writing phase t2, and the light-emitting phase t3) when the low gray scale is displayed is longer than the time during which the element D to be driven is in the continuous dark state (the time during which the element D to be driven does not emit light in the reset phase t1 and the data writing phase t2) when the medium gray scale is displayed and the high gray scale is displayed.

Based on the above related technology, firstly, it may be obtained from the working process of the pixel circuit 2 that the transistor M3 will continuously output the driving signal to the element D to be driven as long as the light-emitting control signal is in the effective signal period. However, in FIG. 3C, the light-emitting control signal includes both the effective signal (at the low level) and the ineffective signal (at the high level) in the light-emitting phase t3, and thus the light-emitting duration t3' is relatively short. Since the light-emitting phase t3 occupies the longest duration in the driving period, the shorter the light-emitting duration t3' in the light-emitting phase t3 is, the shorter the time for the element D to be driven to emit light continuously (also referred to as emitting light concentratedly) is, and the longer the time during which the element D to be driven is in the dark state in the entire driving period. In two adjacent frames of images, if the time during which the element D to be driven is in the dark state is relatively short, human eyes cannot perceive the time period in which the element D to be driven does not emit light in two adjacent frames of images due to a visual delay effect of human eyes. Based on this, the element D to be driven may be considered to be continuously emit light in two adjacent frames of images. If the time during which the element D to be driven is in the dark state is relatively long, human eyes are able to perceive the time period in which the element D to be driven does not emit light in two adjacent frames of images, and thus may perceive flicker between two adjacent frames of images. Based on this when the element D to be driven displays the low gray scale, since the light-emitting duration t3' thereof is relatively short, there is a flicker phenomenon visible to human eyes in the related art, and the flicker phenomenon will affect the display effect of the display panel 1 and the user's viewing experience.

Secondly, referring to FIGS. 3A, 3B and 3C, in the pixel circuit 2, the light-emitting duration is only determined by a duration of the effective signal of the light-emitting control signal. That is, in the pixel circuit 2, no matter whether the element D to be driven needs to display the low gray scale, the medium gray scale or the high gray scale, the light-emitting duration thereof is determined by the effective signal of the light-emitting control signal. In FIG. 3C, in the light-emitting phase t3, the duration of the effective signal of the light-emitting control signal is only t3', and thus the element D to be driven only emits light continuously in the time period of t3' when displaying the low gray scale.

Finally, in a display device, a light-emitting control signal line is coupled to the pixel circuits 2 in the same row, and brightnesses displayed by adjacent elements D to be driven in the same row are not necessarily the same. For example, when one of the elements D to be driven in the same row needs to display a medium gray scale and a high gray scale, and another of the elements D to be driven in the same row needs to display a low gray scale, the same light-emitting control signal line cannot provide light-emitting control signals with different effective level lengths at the same time, and thus in the related art, each pixel circuit 2 needs to be coupled to one light-emitting control signal line, which results in a complicated circuit layout of the display device using the pixel circuit 2.

In the embodiments of the present disclosure, the pixel circuit 2 includes the time control circuit 22. The time control circuit 22 is coupled to the input circuit 21 and is configured to: control the light-emitting duration of the element D to be driven to be the first duration T1 in response to the first control signal provided by the first control signal terminal S1; and control the light-emitting duration of the element D to be driven to be the second duration T2 in response to the second control signal provided by the second control signal terminal Data-D and the third control signal provided by the third control signal terminal HF. The second duration T2 is less than the first duration T1, and the second duration T2 is equal to the sum of the plurality of interval time periods t'. Therefore, compared with the pixel circuit 2 in the related art, the pixel circuit 2 in the embodiments of the present disclosure adds the time control circuit 22 therein, and the time control circuit 22 may control the light-emitting duration of the element D to be driven to be the second duration T2 by controlling the input circuit 21 in response to the second control signal and the third control signal. The second duration T2 is equal to the sum of the plurality of interval time periods t'. That is, the second duration T2 is divided into the plurality of time periods t', and the element D to be driven emits light in each time period t'. Compared with a short-term continuous light emission in the related art, the embodiments of the present disclosure adopts a long-time intermittent light emission when the element D to be driven displays the low gray scale. In a process of the long-time intermittent light emission, due to a persistence of vision effect and a high frequency of the third control signal, human eyes cannot perceive a process in which the element D to be driven becomes dark. Therefore, the element D to be driven keeps emitting light in the light-emitting phase visually, and the time during which the element D to be driven is in the continuous dark state is shortened, which avoids the flicker phenomenon visible to human eyes on the display panel 1 in a process of switching between two frames of images. In addition, in the pixel circuit 2 in the embodiments of the present disclosure, the light-emitting duration of the element D to be driven in the light-emitting phase is indirectly controlled by the time control circuit 22, and the time control circuit 22 may accurately control the light-emitting duration of the element D to be driven by controlling the time during which the input circuit 21 outputs the driving current Id to the element D to be driven according to the gray scale range to which the gray scale to be displayed by the element D to be driven belongs. As a result, the element D to be driven has different light-emitting durations corresponding to different gray scales, which improves the flicker problem that occurs when the element D to be driven displays the low gray scale, and ultimately enhances the display effect of the display panel 1 and the user's experience effect.

In some embodiments, referring to FIGS. 2A to 2C, the time control circuit 22 is further configured to control the light-emitting duration of the element D to be driven to be the second duration T2 through the input circuit 21 in response to the first control signal.

For example, the time control circuit 22 controls the light-emitting duration of the element D to be driven to be the second duration T2 in response to the first control signal, the second control signal and the third control signal.

Since the time control circuit 22 can control the light-emitting duration of the element D to be driven to be the first duration T1 in response to the first control signal, when the time control circuit 22 controls the light-emitting duration of the element D to be driven to be the second duration T2 in response to the first control signal, the second control signal and the third control signal, the time control circuit 22 may control the light-emitting duration of the element D to be driven according to a combination of other signals and the first control signal, and the control is more accurate.

In some embodiments, referring to FIGS. 2B and 2C, the time control circuit 22 is further configured to control the light-emitting duration of the element D to be driven to be the second duration T2 in response to a fourth control signal provided by a fourth control signal terminal S4.

Based on the above, in some embodiments, the time control circuit 22 controls the light-emitting duration of the element D to be driven to be the second duration T2 in response to the second control signal, the third control signal and the fourth control signal.

In some other embodiments, the time control circuit 22 controls the light-emitting duration of the element D to be driven to be the second duration T2 in response to the first control signal, the second control signal, the third control signal and the fourth control signal.

For example, the fourth control signal provided by the fourth control signal terminal S4 is a scanning signal.

In some embodiments, referring to FIGS. 2B and 2C, the fourth control signal terminal S4 is the gate signal terminal Gate, and in this case, the fourth control signal provided by the fourth control signal terminal S4 is a gate signal in the scanning signal.

The display device performs display in a line scanning manner. Therefore, the time control circuits 22 of the pixel circuits 2 in the same row may be controlled simultaneously in response to the gate signal, so that wiring in the display panel 1 is simpler.

Figure 4A:
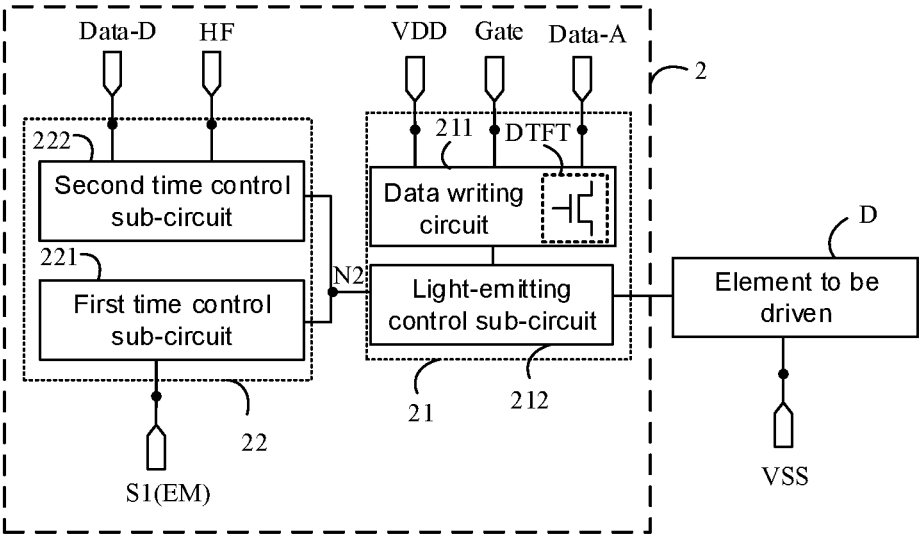
FIGS. 4A to 4D are structural diagrams of yet other pixel circuits, in accordance with some embodiments of the present disclosure.
Figure 4B:
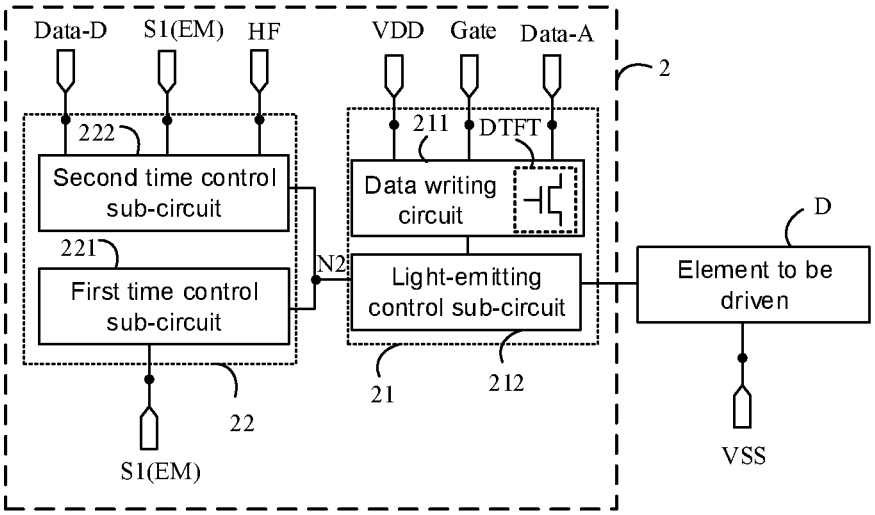

In some embodiments, referring to FIGS. 4A and 4B, the input circuit 21 includes a data writing sub-circuit 211 and a light-emitting control sub-circuit 212 that are coupled to each other.

The data writing sub-circuit 211 is coupled to the gate signal terminal Gate, the data signal terminal Data-A and a first power supply voltage signal terminal VDD. The data writing sub-circuit 211 includes the driving transistor DTFT, and a size of the driving transistor DTFT is, for example, larger than sizes of other transistors in the data writing sub-circuit 211. The data writing sub-circuit 211 is configured to write the data signal provided by the data signal terminal Data-A into the gate of the driving transistor DTFT under control of the gate signal terminal Gate, so that the driving transistor DTFT outputs the driving current Id under control of the gate voltage Vg and the source voltage Vs thereof. How the driving transistor DTFT in the input circuit 21 outputs the driving current Id according to the gate voltage Vg and the source voltage Vs thereof has been described in the foregoing, and thus will not be repeated herein.

The light-emitting control sub-circuit 212 is coupled to the time control circuit 22 and is configured to control the light-emitting duration of the element D to be driven that is driven by the driving transistor DTFT in the data writing sub-circuit 211 according to a signal transmitted by the time control circuit 22.

For example, when the time control circuit 22 transmits the first control signal to the light-emitting control sub-circuit 212, the light-emitting control sub-circuit 212 controls the light-emitting duration of the element D to be driven to be the first duration T1. When the time control circuit 22 transmits the third control signal to the light-emitting control sub-circuit 212, the light-emitting control sub-circuit 212 controls the light-emitting duration of the element D to be driven to be the second duration T2.

Therefore, the time control circuit 22 controls the light-emitting duration of the element D to be driven by controlling the light-emitting control sub-circuit 212 in the input circuit 21.

Figure 5A:
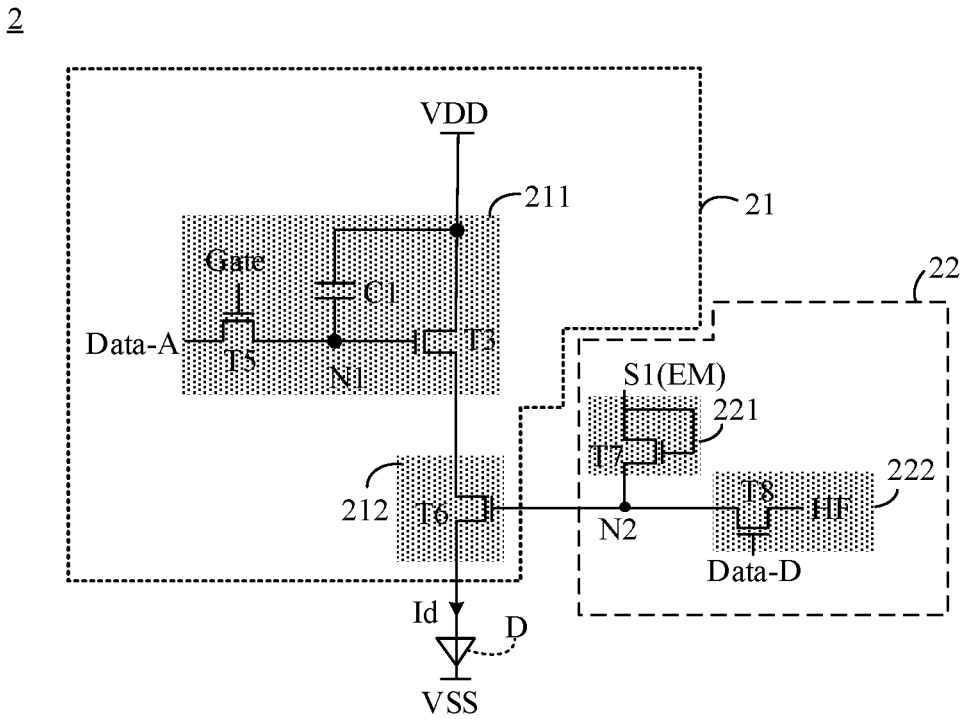
FIGS. 5A to 5D are structural diagrams of yet other pixel circuits, in accordance with some embodiments of the present disclosure.

In some embodiments, referring to FIG. 5A, the data writing sub-circuit 211 includes a third transistor T3, a fifth transistor T5 and a first capacitor C1. The third transistor T3 is the driving transistor DTFT. A gate of the third transistor T3 is coupled to a first node N1, a first electrode of the third transistor T3 is coupled to the first power supply voltage signal terminal VDD. A gate of the fifth transistor T5 is coupled to the gate signal terminal Gate, a first electrode of the fifth transistor T5 is coupled to the data signal terminal Data-A, and a second electrode of the fifth transistor T5 is coupled to the first node N1. One end of the first capacitor C1 is coupled to the first node N1, and the other end of the first capacitor C1 is coupled to the first power supply voltage signal terminal VDD.

The light-emitting control sub-circuit 212 includes a sixth transistor T6. A gate of the sixth transistor T6 is coupled to the time control circuit 22, a first electrode of the sixth transistor T6 is coupled to a second electrode of the third transistor T3, and a second electrode of the sixth transistor T6 is coupled to the anode of the element D to be driven.

Referring to FIG. 5A, in the pixel circuit 2, a working process of the input circuit 21 includes, for example, as follows. In a data writing phase, when the gate signal provided by the gate signal terminal Gate is an effective signal (at a low level), the fifth transistor T5 is turned on to write the data signal provided by the data signal terminal Data-A to the first node N1, and the first capacitor C1 is charged.

In a light-emitting phase, the first capacitor C1 starts to discharge, and the third transistor T3 is turned on, and can output the driving signal due to the action of the gate voltage Vg and the source voltage Vs of the third transistor T3. In this case, the sixth transistor T6 is also in an on state, the driving signal output by the third transistor T3 can be transmitted to the element D to be driven to drive the element D to be driven to emit light.

Figure 5B:
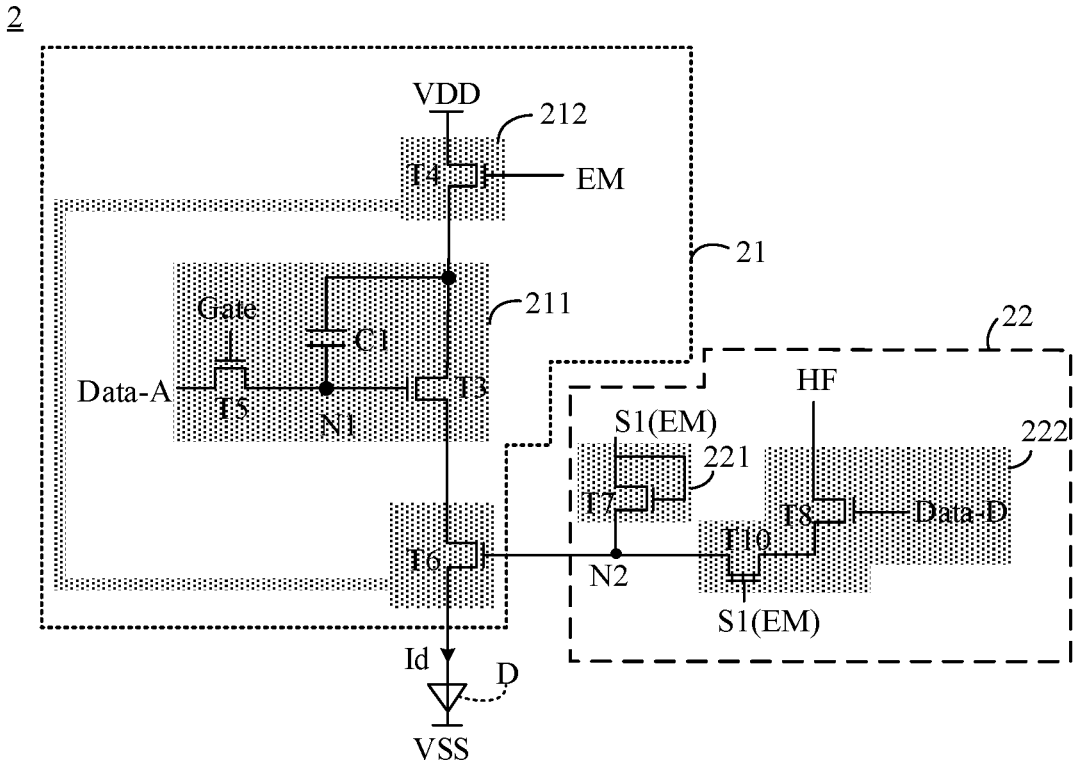

In some embodiments, referring to FIG. 5B, the light-emitting control sub-circuit 212 further includes a fourth transistor T4. A gate of the fourth transistor T4 is coupled to a light-emitting control signal terminal EM, a first electrode of the fourth transistor T4 is coupled to the first power supply voltage signal terminal VDD, and a second electrode of the fourth transistor T4 is coupled to the first electrode of the third transistor T3.

In the light-emitting phase, when the light-emitting control signal provided by the light-emitting control signal terminal EM is an effective signal (at a low level), the fourth transistor T4 is turned on, so that the first power supply voltage signal provided by the first power supply voltage signal terminal VDD may be transmitted to the first electrode of the third transistor T3 to be used when the third transistor T3 outputs the driving signal.

Since the fourth transistor T4 can control coupling of the first power supply voltage signal terminal VDD and the driving transistor DTFT due to an action of the light-emitting control signal, the input circuit 21 may be controlled more accurately by the pixel circuit 2.

Figure 5C:
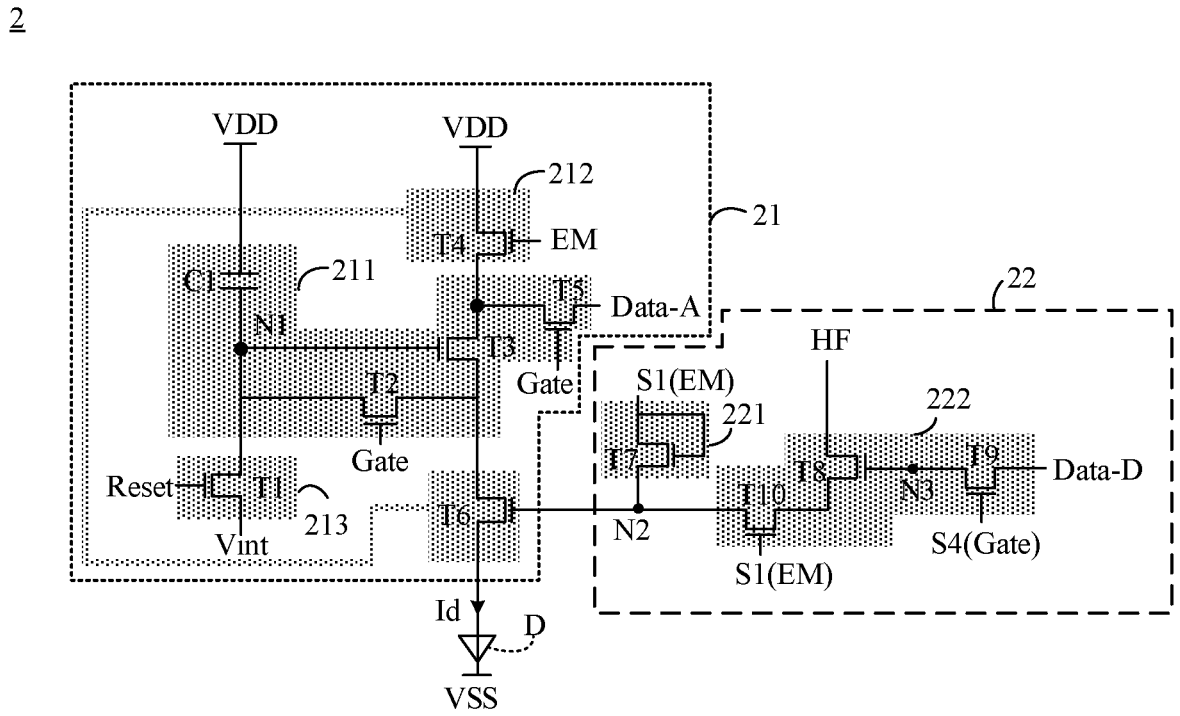
Figure 5D:
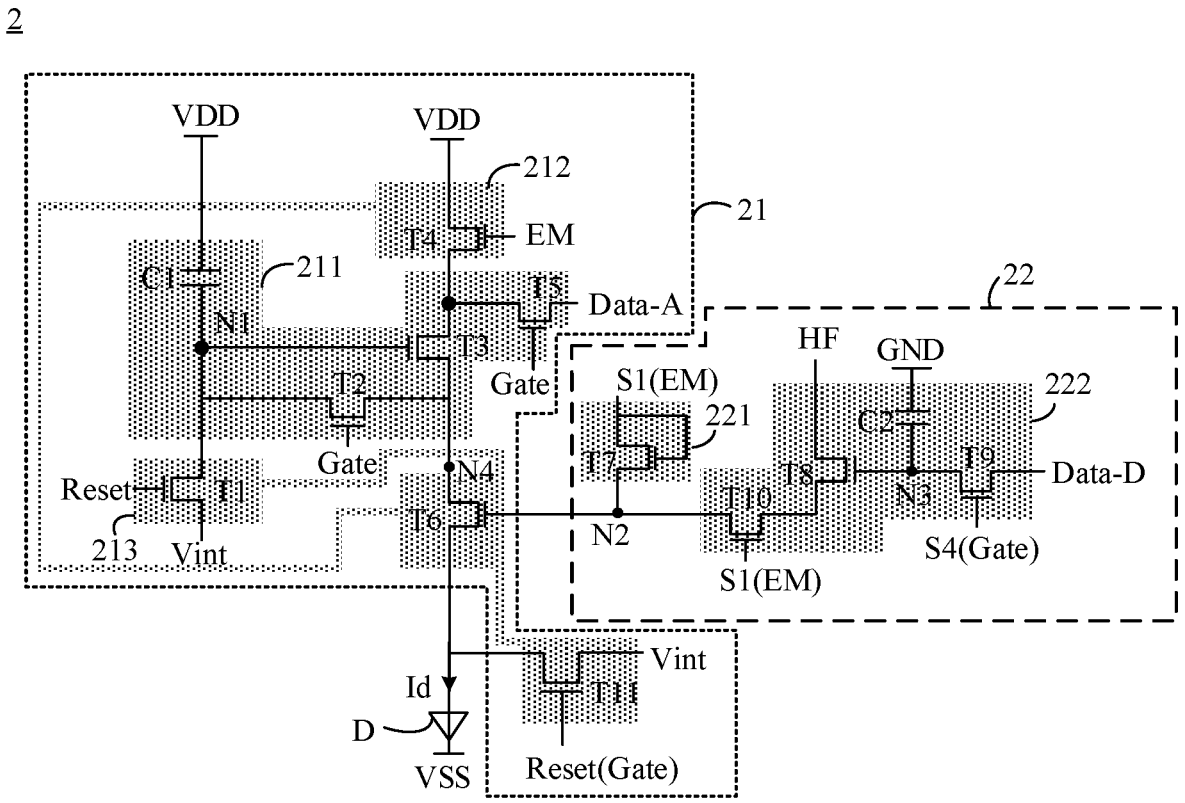

In some embodiments, referring to FIGS. 5C and 5D, the data writing sub-circuit 211 includes a second transistor T2, the third transistor T3, the fifth transistor T5 and the first capacitor C1. The third transistor T3 is the driving transistor DTFT. A gate of the second transistor T2 is coupled to the gate signal terminal Gate, a first electrode of the second transistor T2 is coupled to the second electrode of the third transistor T3, and a second electrode of the second transistor T2 is coupled to the first node N1. The gate of the third transistor T3 is coupled to the first node N1, and the first electrode of the third transistor T3 is coupled to the first power supply voltage signal terminal VDD. The gate of the fifth transistor T5 is coupled to the gate signal terminal Gate, the first electrode of the fifth transistor T5 is coupled to the data signal terminal Data-A, and the second electrode of the fifth transistor T5 is coupled to the first electrode of the third transistor T3. One end of the first capacitor C1 is coupled to the first node N1, and the other end of the first capacitor C1 is coupled to the first power supply voltage signal terminal VDD.

The light-emitting control sub-circuit 212 includes a sixth transistor T6. A gate of the sixth transistor T6 is coupled to the time control circuit 22, a first electrode of the sixth transistor T6 is coupled to the second electrode of the third transistor T3, and a second electrode of the sixth transistor T6 is coupled to the anode of the element D to be driven.

In the data writing phase, when the gate signal is an effective signal, the second transistor T2 and the fifth transistor T5 are turned on, and the data signal and a threshold voltage Vth of the third transistor T3 can be written into the first node N1, and the first capacitor C1 can be charged. The data writing sub-circuit 211 with such a structure may realize compensation for the threshold voltage Vth of the driving transistor DTFT, so that when the driving transistor DTFT outputs the driving signal, a magnitude of the driving signal is independent of the threshold voltage Vth of the driving transistor DTFT, which may avoid difference of display brightnesses due to difference of the threshold voltages Vth of the driving transistors DTFT when different sub-pixels P display the same gray scale, thereby improving the display effect.

For example, the driving signal output by the driving transistor DTFT is the driving current Id.

Referring to FIG. 5D, if the third transistor T3 is a P-type transistor, a gate voltage Vg thereof (i.e., a potential of the first node N1) is equal to $V_{Data\text{-}A}$, and a source thereof is coupled to the first power supply voltage signal terminal VDD, and the source voltage Vs thereof is equal to $V_{DD}$, and thus Vgs is equal to a difference between $V_{Data\text{-}A}$ and $V_{DD}$ ($VgS=V_{Data\text{-}A}-V_{DD}$). If the third transistor T3 is an N-type transistor, the gate voltage Vg thereof is equal to $V_{Data\text{-}A}$, and the source thereof is coupled to a fourth node N4, and the source voltage Vs thereof is equal to a voltage $V_{N4}$ of the fourth node N4, and thus Vgs is equal to a difference between $V_{Data\text{-}A}$ and $V_{N4}$ ($Vgs=V_{Data\text{-}A}-V_{N4}$).

Based on the data writing sub-circuit 211, in some other embodiments, referring to FIGS. 5C and 5D, the light-emitting control sub-circuit 212 includes the fourth transistor T4 and the sixth transistor T6. A gate of the fourth transistor T4 is coupled to the light-emitting control signal terminal EM, a first electrode of the fourth transistor T4 is coupled to the first power supply voltage signal terminal VDD, and a second electrode of the fourth transistor T4 is coupled to the second electrode of the fifth transistor T5. The gate of the sixth transistor T6 is coupled to the time control circuit 22, the first electrode of the sixth transistor T6 is coupled to the second electrode of the third transistor T3, and the second electrode of the sixth transistor T6 is coupled to the anode of the element D to be driven.

A working process of the light-emitting control sub-circuit 212 shown in FIGS. 5C and 5D is the same as the working process of the light-emitting control sub-circuit 212 shown in FIG. 5B described above, which will not be repeated herein.

Figure 4C:
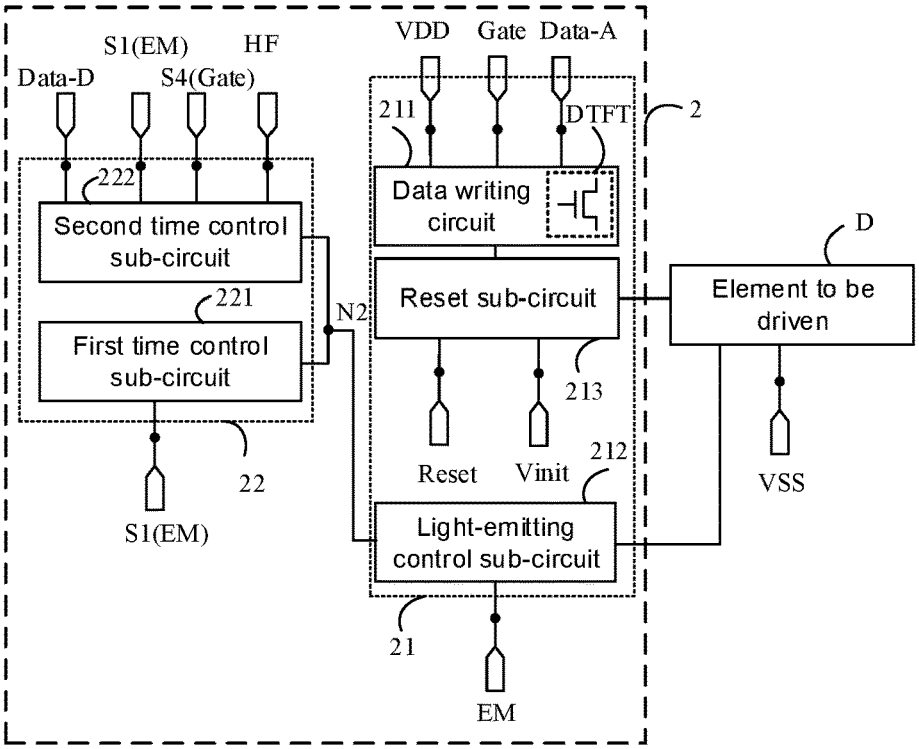

In some embodiments, referring to FIG. 4C, the input circuit 21 further includes a reset sub-circuit 213. The reset sub-circuit 213 is coupled to a reset signal terminal Reset and an initialization signal terminal Vinit, and is configured to reset the driving transistor DTFT or reset the driving transistor DTFT and the element D to be driven through an initialization signal provided by the initialization signal terminal Vinit under control of the reset signal terminal Reset.

Figure 4D:
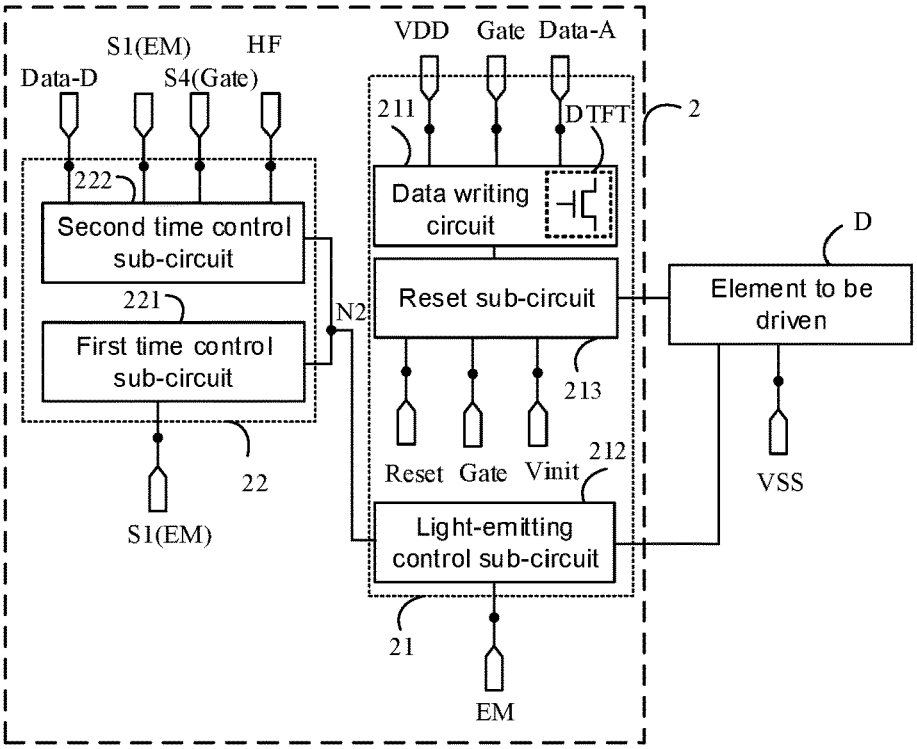

In some other embodiments, referring to FIG. 4D, the reset sub-circuit 213 is coupled to the reset signal terminal Reset, the gate signal terminal Gate and the initialization signal terminal Vinit, and is configured to reset the driving transistor DTFT under the control of the reset signal terminal Reset, and to reset the element D to be driven under the control of the gate signal terminal Gate.

The reset sub-circuit 213 may ensure that a gate potential of the driving transistor DTFT is a correct potential at the beginning of the data writing phase, so that it may be ensured that after the data signal is written into the gate of the driving transistor DTFT, the driving transistor DTFT may output the driving signal corresponding to the data signal.

In some embodiments, referring to FIG. 5C, the reset sub-circuit 213 includes a first transistor T1. A gate of the first transistor T1 is coupled to the reset signal terminal Reset, a first electrode of the first transistor T1 is coupled to the initialization signal terminal Vinit, and a second electrode of the first transistor T1 is coupled to the gate of the driving transistor DTFT (or the first node N1).

For example, in a reset phase, the reset signal provided by the reset signal terminal Reset is an effective signal, and the first transistor T1 is turned on to transmit the initialization signal provided by the initialization signal terminal Vinit to the first node N1 to reset the first node N1.

In some other embodiments, referring to FIG. 5D, the reset sub-circuit 213 includes the first transistor T1 and an eleventh transistor T11. The gate of the first transistor T1 is coupled to the reset signal terminal Reset, the first electrode of the first transistor T1 is coupled to the initialization signal terminal Vinit, and the second electrode of the first transistor T1 is coupled to the gate of the driving transistor DTFT. A gate of the eleventh transistor T11 is coupled to the reset signal terminal Reset or the gate signal terminal Gate, a first electrode of the eleventh transistor T11 is coupled to the initialization signal terminal Vinit, and a second electrode of the eleventh transistor T11 is coupled to the anode of the element D to be driven.

For example, when the gate of the eleventh transistor T11 is coupled to the reset signal terminal Reset, in the reset phase, the reset signal provided by the reset signal terminal Reset is an effective signal, and the first transistor T1 is turned on to transmit the initialization signal provided by the initialization signal terminal Vinit to the first node N1 to reset the first node N1, i.e., reset the gate of the driving transistor DTFT (the third transistor T3); and the eleventh transistor T11 is turned on to transmit the initialization signal provided by the initialization signal terminal Vinit to the anode of the element D to be driven to reset the anode of the element D to be driven.

When the gate of the eleventh transistor T11 is coupled to the gate signal terminal Gate, in the reset phase, the first transistor T1 is turned on to reset the first node N1; in the data writing phase, the gate signal provided by the gate signal terminal Gate is an effective signal, and the eleventh transistor T11 is turned on to transmit the initialization signal provided by the initialization signal terminal Vinit to the anode of the element D to be driven to reset the element D to be driven.

After the reset sub-circuit 213 resets the element D to be driven, an influence of a residual potential of the anode of the element D to be driven in a previous display on a current display may be avoided.

Although the structure of the input circuit 21 has been described in detail above, the structure of the input circuit 21 is only for illustration, and does not limited thereto. It can be understood by those skilled in the art that other types of input circuits 21 may also be applicable to the present disclosure.

Furthermore, in some embodiments, referring to FIG. 4A, the time control circuit 22 includes a first time control sub-circuit 221 and a second time control sub-circuit 222. The first time control sub-circuit 221 is coupled to the first control signal terminal S1 and the second node N2. The second node N2 is coupled to the input circuit 21. The first time control sub-circuit 221 is configured to control the input circuit 21 through the second node N2 under the control of the first control signal terminal S1, so that the light-emitting duration of the element D to be driven is the first duration T1.

The second time control sub-circuit 222 is coupled to the second control signal terminal Data-D, the third control signal terminal HF and the second node N2, and is configured to transmit the third control signal provided by the third control signal terminal HF to the second node N2 under the control of the second control signal terminal Data-D, and to control the input circuit 21 through the second node N2, so that the light-emitting duration of the element D to be driven is the second duration T2.

On this basis, in some embodiments, referring to FIG. 5A, the first time control sub-circuit 221 includes a seventh transistor T7. A gate and a first electrode of the seventh transistor T7 are coupled to the first control signal terminal S1, and a second electrode of the seventh transistor T7 is coupled to the second node N2.

Since the gate of the seventh transistor T7 is coupled to the first electrode thereof, the seventh transistor T7 can be understood as a diode. In this case, whether the first control signal provided by the first control signal terminal S1 is at a high level or a low level, the seventh transistor T7 may be in an on state. Determining whether the seventh transistor T7 is turned on is also related to a potential of the second electrode of the seventh transistor T7. For example, when a voltage of the first control signal is greater than the potential of the second electrode of the seventh transistor T7, the seventh transistor T7 is turned on; when the voltage of the first control signal S1 is less than or equal to the potential of the second electrode of the seventh transistor T7, the seventh transistor T7 is turned off.

The second time control sub-circuit 222 includes an eighth transistor T8. A gate of the eighth transistor T8 is coupled to the second control signal terminal Data-D, a first electrode of the eighth transistor T8 is coupled to the third control signal terminal HF, and a second electrode of the eighth transistor T8 is coupled to the second node N2.

In the light-emitting phase of the pixel circuit 2, when the first control signal is an effective signal, e.g., at a low level, the seventh transistor T7 is turned on to transmit the first control signal to the second node N2. In this case, a potential of the second node N2 is at a low level, so that the sixth transistor T6 is turned on to control the light-emitting duration of the element D to be driven to be the first duration T1.

When the second control signal is at an effective level, the eighth transistor T8 is turned on to transmit the third control signal provided by the third control signal terminal HF to the second node N2, and the sixth transistor T6 is controlled to be in a cyclically on and off state through the second node N2, so that the light-emitting duration of the element D to be driven is the second duration T2, and the second duration T2 is equal to the sum of the plurality of interval time periods t'.

In some embodiments, referring to FIG. 5B, the second time control sub-circuit 222 is also coupled to the first control signal terminal S1. The second time control sub-circuit 222 further includes a tenth transistor T10. A gate of the tenth transistor T10 is coupled to the first control signal terminal S1, a first electrode of the tenth transistor T10 is coupled to the second electrode of the eighth transistor T8, and a second electrode of the tenth transistor T10 is coupled to the second node N2.

In some embodiments, the first control signal terminal is the light-emitting control signal terminal.

The seventh transistor T7 and the tenth transistor T10 are both coupled to the first control signal terminal S1. When the first control signal provided by the first control signal terminal S1 is an effective signal, the seventh transistor T7 may be turned on or off since a working state of the seventh transistor T7 is also related to the potential of the second electrode thereof (the potential of the second node N2). However, when the first control signal is an effective signal, the tenth transistor T10 is always turned on. Based on the above, when the eighth transistor T8 is turned on, the potential of the second node N2 needs to be changed with a change of a signal output by the tenth transistor T10, so as to control the light-emitting duration of the element D to be driven to be the second duration T2. When the eighth transistor T8 is turned on, the third control signal is transmitted to the tenth transistor T10. In this case, the tenth transistor T10 outputs the third control signal to the second node N2. If the seventh transistor T7 is turned off, the potential of the second node N2 will not be affected, and if the seventh transistor T7 is turned on, the potential of the second node N2 is a sum of voltages of the first control signal and the third control signal.

When the third control signal is at a low level, the second node N2 is also at the low level. In this case, the first electrode and the second electrode of the seventh transistor T7 are both at low levels, and thus the seventh transistor T7 is turned on. When the third control signal is at a high level, the second node N2 is at the high level. In this case, the first electrode of the seventh transistor T7 is at a low level, whereas the second electrode of the seventh transistor T7 is at the high level, and thus the seventh transistor T7 may be turned off.

On this basis, in some embodiments, when a width-to-length ratio of the seventh transistor T7 is approximately the same as a width-to-length ratio of the tenth transistor T10, an amplitude of the third control signal can be set to be greater than an amplitude of the first control signal, so that the potential of the second node N2 changes with a change of the third control signal.

In some other embodiments, the width-to-length ratio of the tenth transistor T10 is greater than the width-to-length ratio of the seventh transistor T7. In this case, a driving capability of the tenth transistor T10 is greater than a driving capability of the seventh transistor T7. Therefore, the amplitude of the third control signal can be set to be greater than or equal to the amplitude of the first control signal, so that the potential of the second node N2 changes with a change of the third control signal.

In some embodiments, the width-to-length ratio of the tenth transistor T10 is at least 2 times the width-to-length ratio of the seventh transistor T7.

For example, the width-to-length ratio of the tenth transistor T10 is 2 times, 5 times, or 10 times that of the seventh transistor T7. The larger the difference between the width-to-length ratio of the tenth transistor T10 and the width-to-length ratio of the seventh transistor T7 is, the more favorable it is for the potential of the second node N2 to change with the change of the third control signal.

By adding the tenth transistor T10, the turn-on time of the eighth transistor T8 controlled by the second control signal may be set longer to ensure that the third control signal output by the eighth transistor T8 is relatively stable after the tenth transistor T10 is turned on.

In some embodiments, referring to FIG. 5C, the second time control sub-circuit 222 further includes a ninth transistor T9. A gate of the ninth transistor T9 is coupled to the fourth control signal terminal S4, a first electrode of the ninth transistor T9 is coupled to the second control signal terminal Data-D, and a second electrode of the ninth transistor T9 is coupled to a third node N3. The third node N3 is coupled to the gate of the eighth transistor T8.

Since the second control signal terminal Data-D is coupled to the first electrode of the ninth transistor T9, the ninth transistors T9 of the pixel circuits 2 in the same row may be controlled by the same fourth control signal line CL4 to turn on, and the ninth transistors T9 of the pixel circuits 2 in the same column may be controlled by the same second control signal line CL2. This process is the same as a writing process of the data signal Data-A, and thus the implementation is easier and the wiring of the display device may be simpler.

In some embodiments, the fourth control signal terminal S4 is the gate signal terminal Gate. In this case, not only may the number of signal lines in the display device be reduced and pixels per inch (PPI) of the display device be increased, but also the second time control sub-circuit 222 may be controlled simultaneously when the input circuit 21 is controlled, which makes a signal setting and control process simpler.

In some embodiments, referring to FIG. 5D, the second time control sub-circuit 222 further includes a second capacitor C2. One end of the second capacitor C2 is coupled to the third node N3, and the other end of the second capacitor C2 is coupled to a ground terminal GND.

For example, after the ninth transistor T9 is turned on in the data writing phase, the second control signal is transmitted to the third node N3, and the second capacitor C2 is charged, so that the second capacitor C2 maintains a potential of the third node N3 till the light-emitting phase. When the third node N3 is at a high level, the eighth transistor T8 is turned off; when the third node N3 is at a low level, the eighth transistor T8 is turned on, and the third control signal can be transmitted to the second node N2. Since the second capacitor C2 can maintain the potential of the third node N3 till the light-emitting phase, in the light-emitting phase, when the eighth transistor T8 is required to be in an off state, the second control signal is not required to continuously maintain at a high level Therefore, the time during which the second control signal is at a high level may be shortened, which is beneficial to reducing power consumption of the display device.

In some embodiments, referring to FIG. 5D, the time control circuit 22 includes the seventh transistor T7, the eighth transistor T8, the ninth transistor T9, the tenth transistor T10 and the second capacitor C2.

The gate and the first electrode of the seventh transistor T7 are coupled to the first control signal terminal S1 (the light-emitting control signal terminal EM), and the second electrode of the seventh transistor T7 is coupled to the second node N2. The second node N2 is coupled to the input circuit 21.

The gate of the eighth transistor T8 is coupled to the third node N3, the first electrode of the eighth transistor T8 is coupled to the third control signal terminal HF, and the second electrode of the eighth transistor T8 is coupled to the first electrode of the tenth transistor T10.

The gate of the ninth transistor T9 is coupled to the fourth control signal terminal S4 (the gate signal terminal Gate), the first electrode of the ninth transistor T9 is coupled to the second control signal terminal Data-D, and the second electrode of the ninth transistor T9 is coupled to the third node N3.

The gate of the tenth transistor T10 is coupled to the first control signal terminal S1 (the light-emitting control signal terminal EM), and the second electrode of the tenth transistor T10 is coupled to the second node N2.

One end of the second capacitor C2 is coupled to the third node N3, and the other end of the second capacitor C2 is coupled to the ground terminal GND.

For example, the first control signal is the same as the light-emitting control signal, the fourth control signal is the same as the gate signal. The third control signal is, for example, a square wave signal.

Referring to FIG. 5D, a working process of the time control circuit 22 is as follows.

When only the first control signal is an effective signal, the seventh transistor T7 and the tenth transistor T10 are turned on. However, since the fourth control signal is an ineffective signal, the ninth transistor T9 is turned off, and thus a low level cannot be written into the third node N3, and the eighth transistor T8 is turned off. As a result, the tenth transistor T10 does not output a signal to the second node N2, and a magnitude of the potential of the second node N2 is determined by an output signal of the seventh transistor T7, i.e., determined by the first control signal. Therefore, in this case, the second node N2 is continuously at a low level, and the sixth transistor T6 is continuously turned on. When the input circuit 21 outputs the driving signal, the driving signal can make the light-emitting duration of the element D to be driven be the first duration T1, and the first duration T1 only includes one time period. When brightnesses displayed by the element D to be driven are different, lengths of first durations T1 may be the same or different. For example, when the element D to be driven displays a medium gray scale and a high gray scale, light-emitting durations are the same, that is, the first durations T1 are the same. For another example, a light-emitting duration when the element D to be driven displays a medium gray scale is shorter than a light-emitting duration when the element D to be driven displays a high gray scale. That is, first durations T1 when the element to be driven D displays different gray scales are different, which is not limited in the present disclosure.

When the first control signal and the fourth control signal are effective signals, the seventh transistor T7, the ninth transistor T9 and the tenth transistor T10 are turned on. The ninth transistor T9 transmits the second control signal at a low level to the third node N3 and charges the second capacitor C2. In this case, the eighth transistor T8 is turned on to transmit the third control signal provided by the third control signal terminal HF to the first electrode of the tenth transistor T10, and then to the second node N2 through the tenth transistor T10. Due to control of the tenth transistor T10 and the third control signal, the potential of the second node N2 changes with the change of the third control signal. For example, when the third control signal is a square wave signal, the potential of the second node N2 cyclically changes between a high level and a low level, and thus the sixth transistor T6 will be turned on and off cyclically. When the input circuit 21 outputs the driving signal, since the sixth transistor T6 is turned on and off cyclically, the element D to be driven is cyclically switched between a bright state (light emission) and a dark state (non-light emission). Therefore, the light-emitting duration of the element D to be driven is the second duration T2 including the plurality of time periods t'.

The transistors in the pixel circuit 2 are, for example, all P-type thin film transistors or all N-type thin film transistors. In the embodiments of the present disclosure, the working process of the pixel circuit 2 is described by taking examples in which the thin film transistors in the pixel circuit 2 are all P-type thin film transistors, which are turned on at a low level.

Figure 6A:
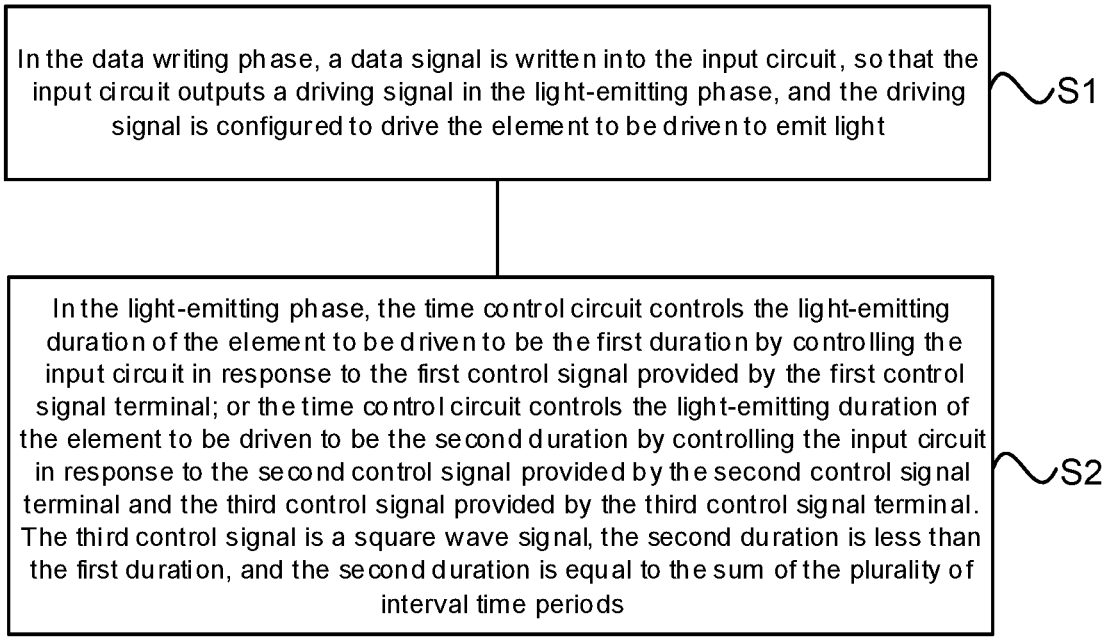
FIGS. 6A to 6C are flow diagrams of methods for controlling pixel circuits, in accordance with some embodiments of the present disclosure.

Referring to FIG. 6A, some embodiments of the present disclosure further provide a method for controlling the pixel circuit 2. The method at least includes a data writing phase and a light-emitting phase.

In S1, in the data writing phase, a data signal is written into the input circuit 21, so that the input circuit 21 outputs a driving signal in the light-emitting phase, and the driving signal is configured to drive the element D to be driven to emit light.

For example, the data writing sub-circuit 211 of the input circuit 21 writes the data signal into the gate of the driving transistor DTFT in the data writing phase.

In S2, in the light-emitting phase, the time control circuit 22 controls the light-emitting duration of the element D to be driven to be the first duration T1 by controlling the input circuit 21 in response to the first control signal provided by the first control signal terminal S1; or the time control circuit 22 controls the light-emitting duration of the element D to be driven to be the second duration T2 by controlling the input circuit 21 in response to the second control signal provided by the second control signal terminal Data-D and the third control signal provided by the third control signal terminal HF. The third control signal is a square wave signal, the second duration T2 is less than the first duration T1, and the second duration T2 is equal to the sum of the plurality of interval time periods t'.

For example, when the element D to be driven needs to display a medium gray scale and a high gray scale, the time control circuit 22 controls the light-emitting duration of the element D to be driven to be the first duration T1 by controlling the input circuit 21.

When the element D to be driven needs to display a low gray scale, the time control circuit 22 controls the light-emitting duration of the element D to be driven to be the second duration T2 by controlling the input circuit 21.

The time control circuit 22 controls the light-emitting duration of the element D to be driven by controlling the input circuit 21, that is, the time control circuit 22 controls the light-emitting duration of the element D to be driven by controlling the time during which the input circuit 21 outputs the driving signal to the element D to be driven. How the time control circuit 22 controls the light-emitting duration of the element D to be driven by controlling the input circuit 21 has been described in the foregoing, and thus will not be repeated herein.

It can be understood by those skilled in the art that the element D to be driven is able to emit light only when it receives the driving signal, and thus the light-emitting duration of the element D to be driven is the same as a duration during which the driving signal is received by the element D to be driven.

The method for controlling the pixel circuit 2 has the same beneficial effects as the pixel circuit 2, and thus will not be repeated herein.

Figure 6B:
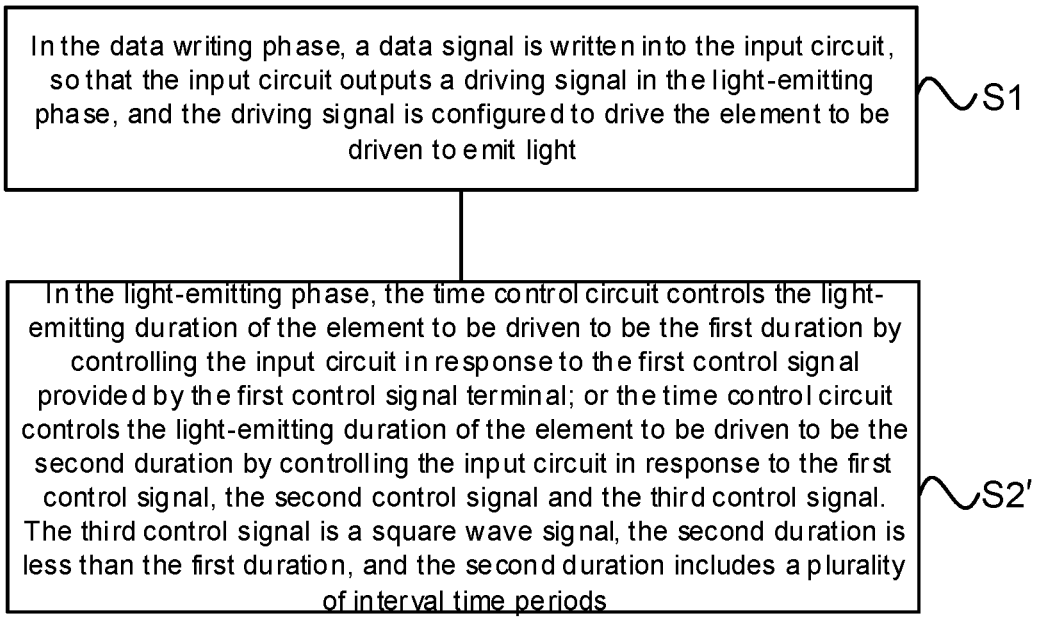

In some embodiments, referring to FIG. 6B, the time control circuit 22 controls the light-emitting duration of the element D to be driven to be the second duration T2 by controlling the input circuit 21 further in response to the first control signal.

For example, in S2', in the light-emitting phase, the time control circuit 22 controls the light-emitting duration of the element D to be driven to be the second duration T2 by controlling the input circuit 21 in response to the first control signal, the second control signal and the third control signal.

For example, the first control signal is, for example, the light-emitting control signal. In the light-emitting phase, when the input circuit 21 is also coupled to the light-emitting control signal terminal EM, it is more convenient to control the time control circuit 22 by the light-emitting control signal, and the time control circuits 22 of the pixel circuits 2 in the same row may also be controlled by the light-emitting control line EML.

Figure 6C:
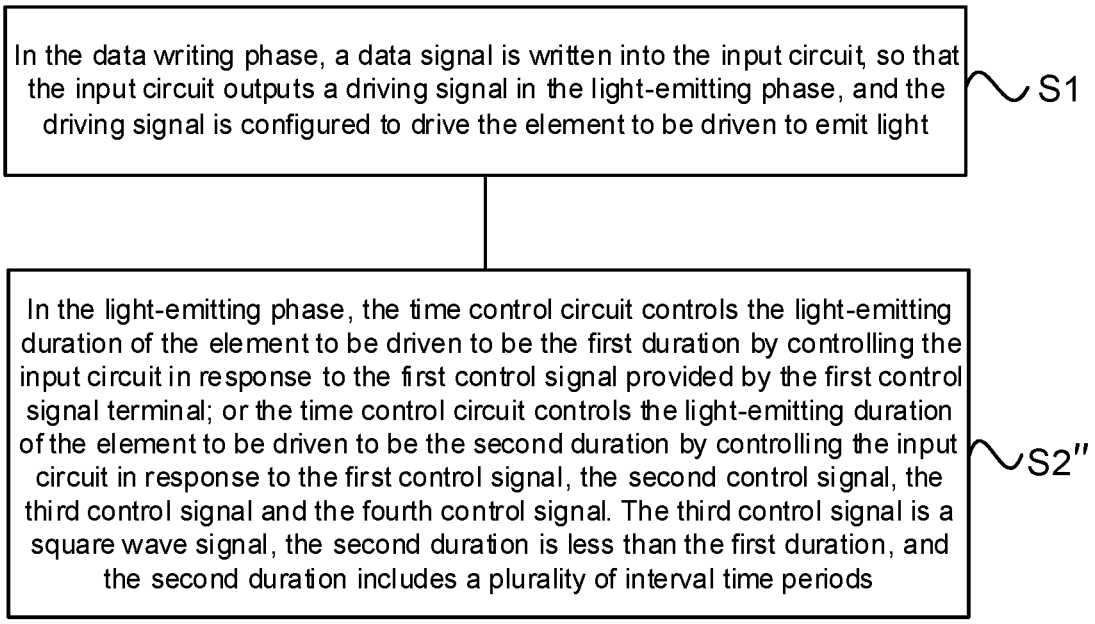

In some embodiments, referring to FIG. 6C, the time control circuit 22 controls the light-emitting duration of the element D to be driven to be the second duration T2 by controlling the input circuit 21 further in response to the fourth control signal provided from the fourth control signal terminal S4.

For example, in S2", in the light-emitting phase, the time control circuit 22 controls the light-emitting duration of the element D to be driven to be the second duration T2 by controlling the input circuit 21 in response to the first control signal, the second control signal, the third control signal and the fourth control signal.

For example, the fourth control signal is, for example, the gate signal. In this case, the time control circuits 22 of the pixel circuits 2 in the same row may be controlled by the gate line GL, so that the number of signal lines in the display device may be reduced, and a layout of circuits is simpler and the control is more convenient.

With reference to the above description, since the light-emitting control signal and the gate signal are also used in the input circuit 21, when the first control signal is the light-emitting control signal and the fourth control signal is the gate signal, the number of signals in the display panel 1 may be reduced and the control may be more convenient, and the wiring of a display panel 1 may be simpler and the pixel density may be higher.

A working process of the pixel circuit 2 in a driving period in one frame of image will be described in detail below with reference to the structure and a timing diagram of the pixel circuit 2.

When the element D to be driven needs to display the medium gray scale and the high gray scale, the element D to be driven has high luminous efficiency, good color coordinate uniformity and stable light-emitting main wavelength. Therefore, when different elements D to be driven display the same gray scale, difference between brightnesses displayed actually is very small, and the same gray scale is displayed by directly providing the same light-emitting duration and driving signals with the same amplitude to different elements D to be driven. When different elements D to be driven display different gray scales, different gray scales are displayed by fixing the light-emitting duration and changing amplitudes of driving signals, e.g., amplitudes of driving currents Id.

Figure 7A:
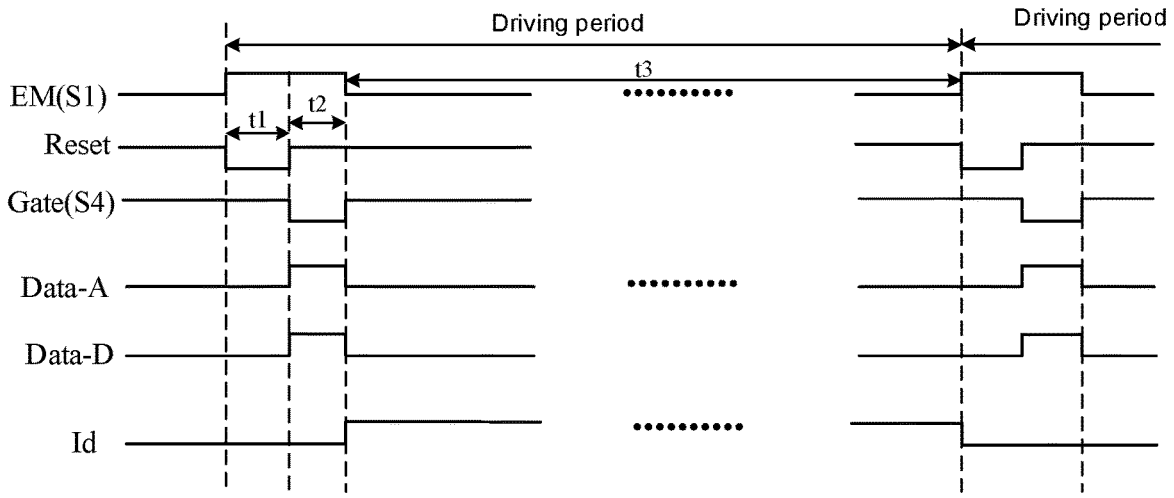
FIG. 7A is a timing diagram of a pixel circuit when displaying a high gray scale or displaying a medium gray scale and a high gray scale, in accordance with some embodiments of the present disclosure.

For example, for the structure of the pixel circuit 2 shown in FIG. 5D with reference to FIG. 7A, in the reset phase t1, the reset signal provided by the reset signal terminal Reset is, for example, at a low level, and other signals input into the pixel circuit 2 are all at a high level. In this case, the first transistor T1 is turned on. Or in a case where the gate of the eleventh transistor T11 is coupled to the reset signal terminal Reset, the first transistor T1 and the eleventh transistor T11 are turned on. The first transistor T1 transmits the initialization signal provided by the initialization signal terminal Vinit to the first node N1 to reset the first node N1, so as to ensure that an initial potential of the first node N1 is a correct potential in a process of displaying a current frame of image. The eleventh transistor T11 transmits the initialization signal to the anode of the element D to be driven to reset the anode of the element D to be driven, so as to eliminate a residual potential of the anode of the element D to be driven. In this process, no driving current Id flows into the element D to be driven, and the element D to be driven is in the dark state.

For example, the initialization signal has the same magnitude as a second power supply voltage signal VSS input to a cathode of the element D to be driven, e.g., 0 V.

In the data writing phase t2, the gate signal is at a low level, and the second transistor T2, the fifth transistor T5 and the ninth transistor T9 are turned on. After the second transistor T2 and the fifth transistor T5 are turned on, the data signal provided by the data signal terminal Data-A and the threshold voltage Vth of the third transistor T3 can be written into the first node N1 through the third transistor T3. After the ninth transistor T9 is turned on, the second control signal provided by the second control signal terminal Data-D can be written into the third node N3, and the capacitor C2 is charged; and in this case, since the second control signal is set to be at a high level, the potential of the third node N3 is at the high level, and the eighth transistor T8 is in an off state.

In some embodiments, when the gate of the eleventh transistor T11 is coupled to the gate signal terminal Gate, the eleventh transistor T11 is also turned on in the data writing phase t2 to reset the anode of the element D to be driven.

When the element D to be driven needs to display the medium gray scale and the high gray scale, the sixth transistor T6 needs to be turned on for the first duration T1, and thus the second control signal is set to be at the high level, so that the eighth transistor T8 is turned off.

In the data writing phase t2, the reset signal and the light-emitting control signal provided by the light-emitting control signal terminal EM are both at a high level. In this case, the first transistor T1 and the fourth transistor T4 are turned off, and the input circuit 21 does not output the driving current Id.

In the light-emitting phase t3, the reset signal and the gate signal are at a high level, and the first transistor T1, the second transistor T2, the fifth transistor T5, the ninth transistor T9 and the eleventh transistor T11 are turned off. Due to existence of the first capacitor C1, in the light-emitting phase t3, the first capacitor C1 starts to discharge to raise the potential of the first node N1, so that the third transistor T3 is turned on. Due to existence of the second capacitor C2, the high potential of the third node N3 may be maintained, so that the eighth transistor T8 is maintained off.

In the light-emitting phase t3, the light-emitting control signal (the first control signal) is at a low level, and the fourth transistor T4, the seventh transistor T7 and the tenth transistor T10 are turned on. After the fourth transistor T4 is turned on, the first power supply voltage signal provided by the first power supply voltage signal terminal VDD is transmitted to the first electrode of the third transistor T3. Under the control of the first node N1, the third transistor T3 is turned on and outputs the driving current Id. Although the tenth transistor T10 is turned on, the tenth transistor T10 has no signal input and output since the eighth transistor T8 is turned off. Therefore, the seventh transistor T7 transmits the light-emitting control signal (the first control signal) at the low level to the second node N2, so that the sixth transistor T6 is continuously turned on, and transmits the driving current Id to the element D to be driven to drive the element D to be driven to emit light. In this case, the light-emitting duration of the element D to be driven is the first duration T1, and in this process, the element D to be driven continuously emit light for the first duration T1.

Since the seventh transistor T7 is turned on and the eighth transistor T8 is turned off, the first time control sub-circuit 221 can work normally in a process of displaying the middle gray scale and the high gray scale, the potential of the second node N2 is the same as a voltage of the light-emitting control signal (the first control signal), and the second time control sub-circuit 222 is in an off state.

It can be understood by those skilled in the art that, the potential of the first node N1 determines the magnitude of the driving current Id generated by the third transistor T3, and the potential of the first node N1 is written by the data signal, and thus the data signal determines the magnitude of the driving current Id, and different data signals may control the element D to be driven to display different brightnesses.

When the element D to be driven needs to display the low gray scale, stability of the element D to be driven is poor. As a result, when different elements D to be driven display the same gray scale, difference between brightnesses displayed actually is larger. Therefore, in a case where the driving current Id enables the element D to be driven to work stably, it is necessary to control brightnesses displayed by different elements D to be driven by controlling the light-emitting duration of each element D to be driven.

Figure 7B:
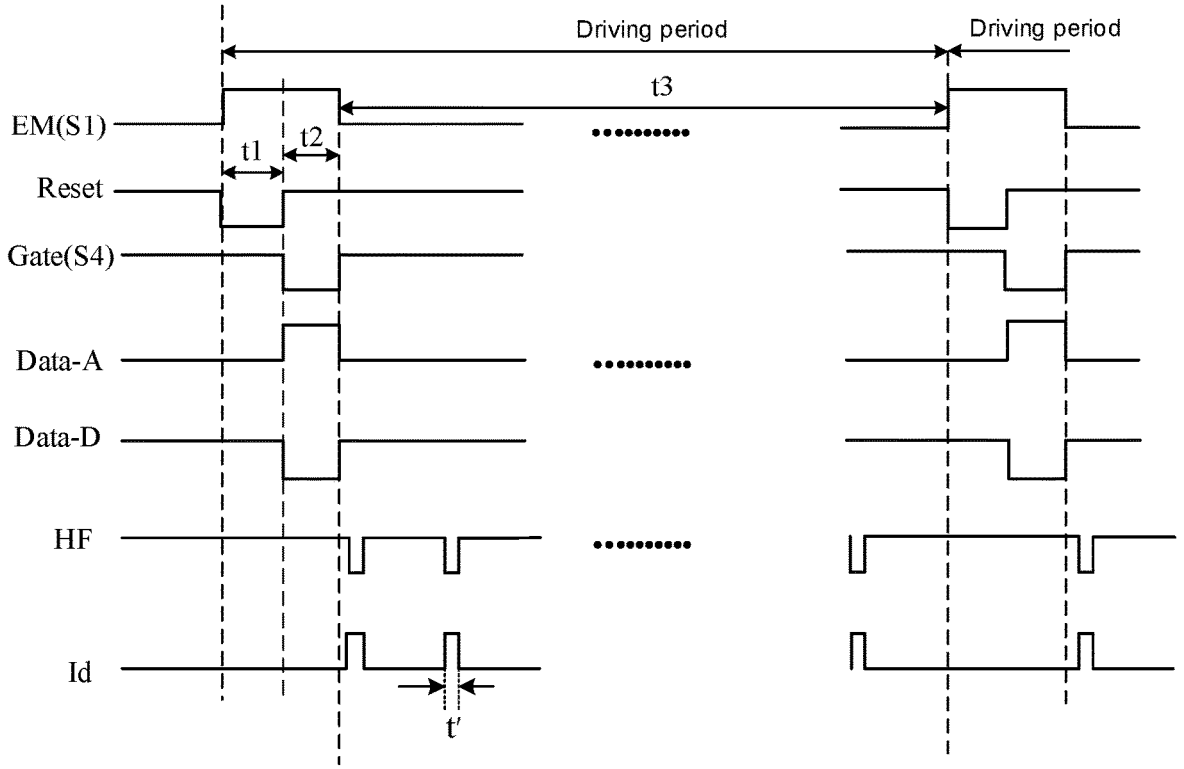
FIG. 7B is a timing diagram of a pixel circuit when displaying a low gray scale, in accordance with some embodiments of the present disclosure.
Figure 7C:
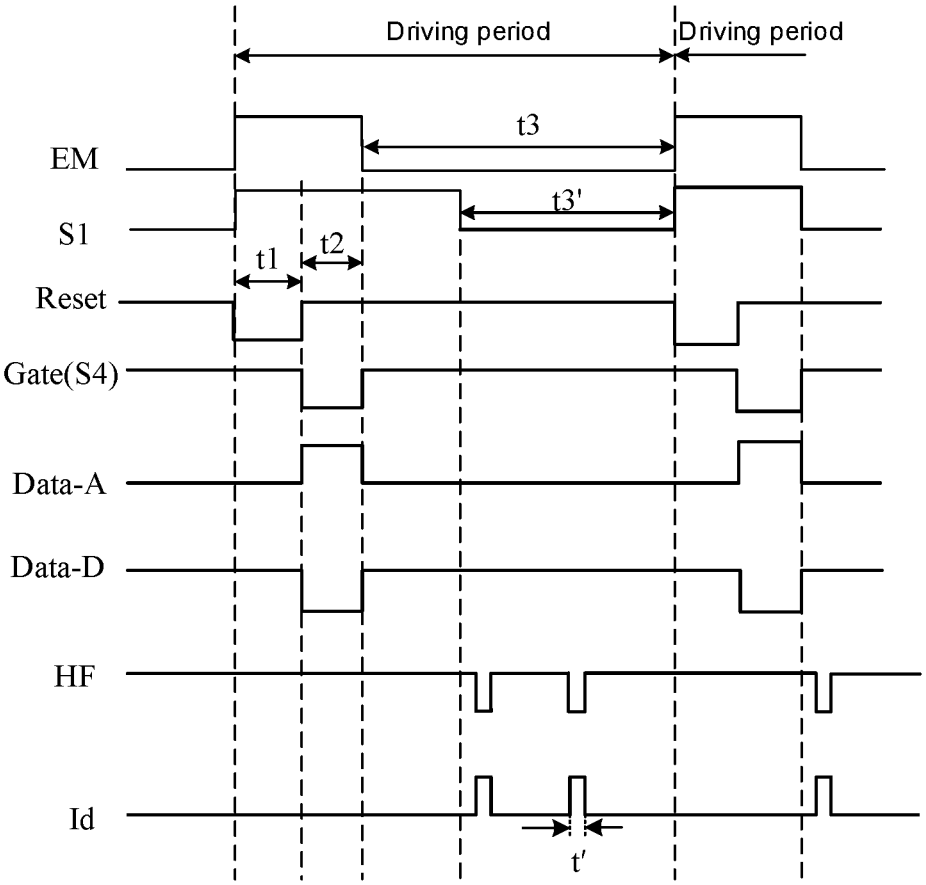
FIG. 7C is a timing diagram of another pixel circuit when displaying a low gray scale, in accordance with some embodiments of the present disclosure.

For another example, for the pixel structure shown in FIG. 5D with reference to FIG. 7B or FIG. 7C, in the reset phase t1, the reset signal provided by the reset signal terminal Reset is, for example, at a low level, and other signals input into the pixel circuit 2 are all at a high level. In this case, the first transistor T1 is turned on. Or in a case where the gate of the eleventh transistor T11 is coupled to the reset signal terminal Reset, the first transistor T1 and the eleventh transistor T11 are turned on. The first transistor T1 transmits the initialization signal provided by the initialization signal terminal Vinit to the first node N1 to reset the first node N1, so as to ensure that an initial potential of the first node N1 is a correct potential in a process of displaying a current frame of image, The eleventh transistor T11 transmits the initialization signal to the anode of the element D to be driven to reset the anode of the element D to be driven, so as to eliminate a residual potential of the anode of the element D to be driven. In this process, no driving current Id flows into the element D to be driven, and the element D to be driven is in the dark state.

For example, the initialization signal has the same magnitude as the second power supply voltage signal VSS, e.g., 0 V.

In the data writing phase t2, the gate signal is at a low level, the second transistor T2, the fifth transistor T5 and the ninth transistor T9 are turned on. After the second transistor T2 and the fifth transistor T5 are turned on, the data signal provided by the data signal terminal Data-A and the threshold voltage Vth of the third transistor T3 can be written into the first node N1 through the third transistor T3. after the ninth transistor T9 is turned on, the second control signal provided by the second control signal terminal Data-D can be written into the third node N3, and the capacitor C2 is charged. In this process, the second control signal is set to be at a low level, and thus the third node N3 is written into the low level, and the eighth transistor T8 is turned on.

In some embodiments, in a case where the gate of the eleventh transistor T11 is coupled to the gate signal terminal Gate, the eleventh transistor T11 is also turned on in the data writing phase t2 to reset the anode of the element D to be driven.

When the element D to be driven needs to display the low gray scale, the potential of the second node N2 needs to be controlled by the third control signal, and thus the eighth transistor T8 needs to be turned on, and the second control signal is set to be at the low level.

In the data writing phase t2, the reset signal and the light-emitting control signal are both at a high level. In this case, the first transistor T1 and the fourth transistor T4 are turned off, and the input circuit 21 does not output the driving current Id.

In the light-emitting phase t3, the reset signal and the gate signal are at a high level, and the first transistor T1, the second transistor T2, the fifth transistor T5, the ninth transistor T9 and the eleventh transistor T11 are turned off. Due to existence of the first capacitor C1, in the light-emitting phase t3, the first capacitor C1 starts to discharge to raise the potential of the first node N1, so that the third transistor T3 is turned on. Due to existence of the second capacitor C2, the low potential of the third node N3 may be maintained, so that the eighth transistor T8 is maintained on.

In the light-emitting phase t3, the light-emitting control signal (the first control signal) is at a low level, and the fourth transistor T4 and the tenth transistor T10 are turned on. After the fourth transistor T4 is turned on, the first power supply voltage signal provided by the first power supply voltage signal terminal VDD is transmitted to the first electrode of the third transistor T3. Under the control of the first node N1, the third transistor T3 is turned on and outputs the driving current Id. When the tenth transistor T10 is turned on, the third control signal is transmitted to the second node N2 through the eighth transistor T8 and the tenth transistor T10. When the third control signal is at a low level, since the light-emitting control signal is also at the low level, the seventh transistor T7 is in an on state, and the first control signal is transmitted to the second node N2 through the seventh transistor T7. When the third control signal is at a high level, since the light-emitting control signal is at the low level, and in this case, voltages of the first electrode and the gate of the seventh transistor T7 are less than a voltage of the second electrode of the seventh transistor T7, the seventh transistor T7 will be turned off. In summary, the potential of the second node N2 changes with the change of the third control signal. The sixth transistor T6 is turned on and off cyclically under the control of the third control signal. When the sixth transistor T6 is turned on, the driving current Id can be transmitted to the element D to be driven to drive the element D to be driven to emit light; and when the sixth transistor T6 is turned off, the driving current Id is not transmitted to the element D to be driven, and the element D to be driven stops emitting light. In on and off processes of the sixth transistor T6, the light-emitting control signal is an effective signal, and the third transistor T3 continuously outputs the driving current Id, and thus a working state of the sixth transistor T6 determines whether the driving current Id can be transmitted to the element D to be driven. Therefore, when the sixth transistor T6 is turned on and off cyclically with the change of the third control signal, the second duration T2 is equal to the sum of the plurality of interval time periods t'. For example, referring to the third control signal shown in FIGS. 7B and 7C, which is a square wave signal including the low levels and the high levels that are distributed continuously and at intervals, the element D to be driven emits light in each time period t' in which the low level lasts, and the element D to be driven is in the dark state in each time period in which the high level lasts, and thus the element D to be driven is switched between the bright state and the dark state. However, since the dark state between two adjacent bright states lasts for a short time, human eyes cannot perceive a process in which the element D to be driven is in the dark state, and the element D to be driven is considered to be always emitting light. Therefore, the light-emitting duration of the element D to be driven is considered by the user to be longer than an actual light-emitting duration of the element D to be driven, and further the user does not perceive that there is flicker in the light-emitting process of the element D to be driven when watching images.

Based on the above, in a process of displaying the low gray scale, at least the second time control sub-circuit 222 can work normally, so that the time during which the input circuit 21 outputs the driving signal to the element D to be driven changes with the change of the third control signal. In a case where the third control signal is at the low level, both the first time control sub-circuit 221 and the second time control sub-circuit 222 can work normally.

It will be noted that in a display process of the element D to be driven, when the light-emitting control signal is at the high level in the reset phase t1 and the data writing phase t2, although the seventh transistor T7 is also turned on, turning on of the seventh transistor T7 in these phases is meaningless. Therefore, a working state of the seventh transistor T7 is not described in the reset phase t1 and the data writing phase t2.

It will be noted that the first duration T1 and the second duration T2 are both the light-emitting duration of the element D to be driven. Since the second duration T2 is equal to the sum of the plurality of interval time periods t', the second duration T2 does not include the time between two adjacent time periods t', during which the element D to be driven is in the dark state.

On this basis, for example, referring to FIGS. 7A and 7B, a duration in which the light-emitting control signal is an effective signal when the element D to be driven displays the medium gray scale and the high gray scale is equal to a duration in which the light-emitting control signal is an effective signal when the element D to be driven displays the low gray scale. Generally, if a design space of a high-resolution display panel 1 is taken into consideration, the pixel circuits 2 in the same row may receive the same light-emitting control signal, and for the pixel circuits 2 in the same row, the light-emitting control signal includes only one effective signal period in one frame.

Figure 7D:
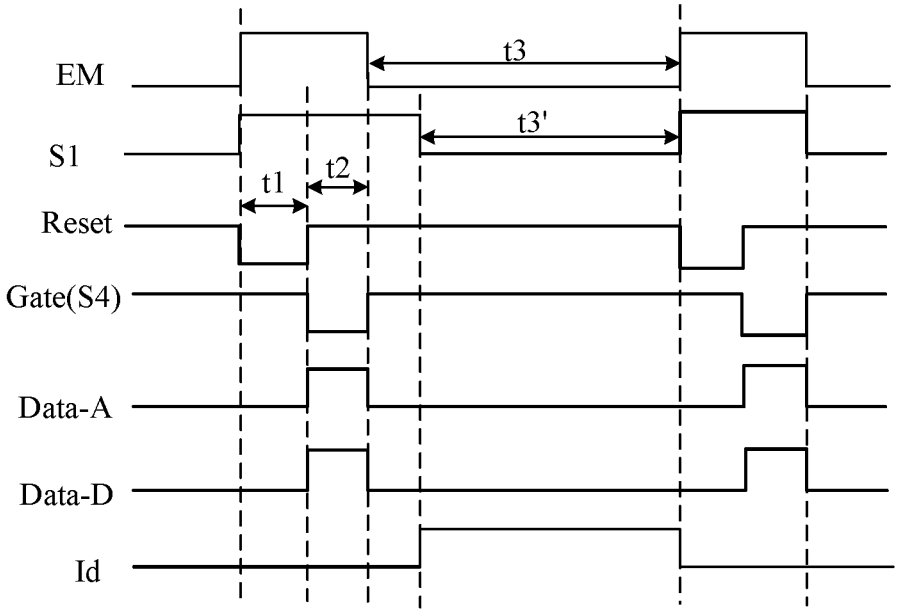
FIG. 7D is a timing diagram of another pixel circuit when displaying a medium gray scale, in accordance with some embodiments of the present disclosure.

It can be understood that, as shown in FIGS. 7C and 7D, the light-emitting control signal terminal EM and the first control signal terminal S1 are independent signal terminals, and an effective signal period t3' of the first control signal is located within an effective signal period t3 of the light-emitting control signal. For one pixel circuit, although the light-emitting control signal has only one effective signal period in one frame, the light-emitting duration of the element D to be driven may be determined by whether the first control signal terminal S1 outputs an effective level signal in the light-emitting phase and a length of time for outputting the effective signal, and the second control signal. When the element D to be driven displays the low gray scale, the shorter the duration in which the first control signal output by the first control signal terminal S1 is an effective signal, the fewer the number of the plurality of time periods t' included in the second duration T2, and the more accurate gray scale display may be realized.

In some other embodiments, a duration in which the light-emitting control signal is an effective signal when the element D to be driven displays the high gray scale is sequentially longer than a duration in which the light-emitting control signal is an effective signal when the element D to be driven displays the medium gray scale and a duration in which the light-emitting control signal is an effective signal when the element D to be driven displays the low gray scale. In such a timing sequence, according to the characteristic of a gray scale displayed by the element D to be driven, the driving current Id and the light-emitting duration that have a higher conformity with the gray scale may be set, so as to improve the display effect of the display panel 1 to the greatest extent.

In some embodiments, in one driving period, the light-emitting control signal includes one effective signal period. When the display device adopts the timing diagrams shown in FIGS. 7A and 7B, the pixel circuits 2 in the same row share the same light-emitting control signal line EML, and the light-emitting control signal line EML is also used as the first control signal line CL1, so that the number of signal lines in the display panel 1 may be reduced to increase a design space and an effective display area of the display panel 1.

In the embodiments of the present disclosure, in a case where the low gray scale is displayed, in the light-emitting phase t3, when the light-emitting control signal is at an effective level, although the driving transistor DTFT continuously outputs the driving current Id, due to an effect of the third control signal, the sixth transistor T6 is not always in an on state, but is turned on and off cyclically. Therefore, the element D to be driven emits light as the sixth transistor T6 is turned on, and stops emitting light as the sixth transistor T6 is turned off. That is, the element D to be driven is cyclically switched between the bright state and the dark state, and emits light intermittently, so as to visually prolong the light-emitting duration of the element D to be driven, and avoid a problem of poor display effect caused by a situation where the element D to be driven is in a continuous dark state for a long time.

For example, a frame frequency of the display panel 1 is 60 Hz. That is, within 1 second (1 S), the display panel 1 may display 60 frames of images, and a display duration of each frame of image is equal. On this basis, the third control signal is, for example, a high-frequency signal of 3000 Hz, and thus each element D to be driven may emit light 50 times in one frame of image. that is, the second duration T2 includes 50 time periods t'.

It will be noted that a duty cycle of the third control signal may be designed and adjusted, so that the time periods t' may have the same or different lengths, which is not limited in the present disclosure.

For example, both in the related art and the embodiments of the present disclosure, the light-emitting duration of the element D to be driven is 10 microseconds when the low gray scale is displayed. In the related art, the element D to be driven continuously emits light for 10 microseconds, whereas in the embodiments of the present disclosure, the 10-microsecond light-emitting duration is divided into 50 time periods t', then each time period t' is 0.2 microseconds, and the element D to be driven emits light 50 times intermittently at a high frequency in a time period of 10 microseconds.

In the related art, when the display panel 1 displays the low gray scale, a relatively large driving current Id is used to ensure that the operation of the element D to be driven is relatively stable. In this case, due to the large driving current Id, the continuous light-emitting duration of the element D to be driven is short, and thus the user may feel a flicker when two frames of images are switched, which affects the display effect of the display panel 1 and the user's experience. In the embodiments of the present disclosure, when the display panel 1 displays the low gray scale, the second duration T2 is divided into the plurality of interval time periods t', and compared with the element D to be driven continuous emitting light for a short time in the related art, the element D to be driven intermittently emits light for a long time in the embodiments of the present disclosure. As a result, the light-emitting duration of the element D to be driven is visually prolonged, and a time period in which the element D to be driven is in the continuous dark state is shortened. Therefore, when two frames of images are switched, the user cannot feel the flicker, and the display effect of the display panel 1 is improved.

It can be understood by those skilled in the art that, although the second duration T2 in the embodiments of the present disclosure may be equal to the light-emitting duration when the low gray scale is displayed in the related art, the second duration T2 in the embodiments of the present disclosure is composed of the plurality of time periods t', and there is an interval between two adjacent time periods t'. Therefore, in the embodiments of the present disclosure, in the case where the light-emitting duration of the element D to be driven is the second duration T2, a total duration (a sum of the second duration T2 and time intervals between adjacent time periods t') in which the element D to be driven changes between the bright state and the dark state is longer than the light-emitting duration when the low gray scale is displayed in the related art, and thus the light-emitting duration of the element D to be driven may be prolonged visually.

Based on the above, in the embodiments of the present disclosure, in a process of analyzing FIGS. 7A to 7D, it can be known that durations of driving periods of the pixel circuits 2 in different rows may be the same. The present disclosure does not limit whether the driving periods of the pixel circuits 2 are the same.

It will be noted that in FIGS. 7A to 7D, although the phases in which a signal shown in the two consecutive driving periods is an effective signal are the same, this is only for illustration. It can be understood by those skilled in the art that, for the same pixel circuit 2, a brightness displayed in a current frame of image and a brightness displayed in a next frame of image may be the same or different. When brightnesses displayed in the current frame of image and in the next frame of image are different, the phases in which the signal is effective signal in the two consecutive driving periods in the pixel circuit 2 may be different. For example, a certain pixel circuit 2 needs to display a high gray scale in the current frame, and needs to display a low gray scale in the next frame, and in this case, the phases in which the signal in the two consecutive driving periods corresponding to the pixel circuit 2 is the effective signal are different. Therefore, although the signal of the two consecutive phases shown in FIGS. 7A to 7D are the same, the present disclosure is not limited thereto.

The foregoing descriptions are merely specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

What is claimed is:

1. A pixel circuit, comprising:

an input circuit configured to output a driving signal to an element to be driven, so that the element to be driven emits light; and a time control circuit coupled to the input circuit and configured to control a light-emitting duration of the element to be driven to be a first duration by controlling the input circuit in response to a first control signal provided by a first control signal terminal, and control the light-emitting duration of the element to be driven to be a second duration by controlling the input circuit in response to at least a second control signal provided by a second control signal terminal and a third control signal provided by a third control signal terminal; the second duration being less than the first duration, and the second duration including a plurality of interval time periods.

2. The pixel circuit according to claim 1, wherein the time control circuit is configured to control the light-emitting duration of the element to be driven to be the second duration by controlling the input circuit in response to the first control signal, the second control signal and the third control signal.

3. The pixel circuit according to claim 1, wherein the time control circuit is configured to control the light-emitting duration of the element to be driven to be the second duration by controlling the input circuit in response to the second control signal, the third control signal and a fourth control signal provided by a fourth control signal terminal; or the time control circuit is configured to control the light-emitting duration of the element to be driven to be the second duration by controlling the input circuit in response to the first control signal, the second control signal, the third control signal, and a fourth control signal provided by a fourth control signal terminal.

4. The pixel circuit according to claim 3, wherein the fourth control signal terminal is a gate signal terminal, and the gate signal terminal is coupled to the input circuit.

5. The pixel circuit according to claim 1, wherein the time control circuit includes a first time control sub-circuit and a second time control sub-circuit; the first time control sub-circuit is coupled to the first control signal terminal and a second node, and the second node is coupled to the input circuit; the first time control sub-circuit is configured to control the input circuit through the second node under control of the first control signal terminal, so that the light-emitting duration of the element to be driven is the first duration; and the second time control sub-circuit is coupled to the second control signal terminal, the third control signal terminal and the second node, and is configured to transmit the third control signal provided by the third control signal terminal to the second node under control of the second control signal terminal, and to control the input circuit through the second node, so that the light-emitting duration of the element to be driven is the second duration.

6. The pixel circuit according to claim 5, wherein the first time control sub-circuit includes a seventh transistor; a gate and a first electrode of the seventh transistor are coupled to the first control signal terminal, and a second electrode of the seventh transistor is coupled to the second node.

7. The pixel circuit according to claim 6, wherein the second time control sub-circuit includes an eighth transistor; a gate of the eighth transistor is coupled to the second control signal terminal, a first electrode of the eighth transistor is coupled to the third control signal terminal, and a second electrode of the eighth transistor is coupled to the second node; or the second time control sub-circuit is further coupled to the first control signal terminal; the second time control sub-circuit includes an eighth transistor and a tenth transistor; a gate of the eighth transistor is coupled to the second control signal terminal, and a first electrode of the eighth transistor is coupled to the third control signal terminal; a gate of the tenth transistor is coupled to the first control signal terminal, a first electrode of the tenth transistor is coupled to a second electrode of the eighth transistor, and a second electrode of the tenth transistor is coupled to the second node; and a width-to-length ratio of the tenth transistor is greater than a width-to-length ratio of the seventh transistor.

8. The pixel circuit according to claim 7, wherein the width-to-length ratio of the tenth transistor is at least 2 times the width-to-length ratio of the seventh transistor.

9. The pixel circuit according to claim 5, wherein the second time control sub-circuit includes an eighth transistor; a gate of the eighth transistor is coupled to the second control signal terminal, a first electrode of the eighth transistor is coupled to the third control signal terminal, and a second electrode of the eighth transistor is coupled to the second node.

10. The pixel circuit according to claim 9, wherein the second time control sub-circuit further includes a ninth transistor, and the gate of the eighth transistor is coupled to the second control signal terminal through the ninth transistor; a gate of the ninth transistor is coupled to a fourth control signal terminal, a first electrode of the ninth transistor is coupled to the second control signal terminal, and a second electrode of the ninth transistor is coupled to a third node.

11. The pixel circuit according to claim 10, wherein the second time control sub-circuit further includes a second capacitor; one end of the second capacitor is coupled to the third node, and another end of the second capacitor is coupled to a ground terminal.

12. The pixel circuit according to claim 1, wherein the time control circuit includes: a seventh transistor, an eighth transistor, a ninth transistor, a tenth transistor and a second capacitor;

a gate and a first electrode of the seventh transistor are coupled to the first control signal terminal, a second electrode of the seventh transistor is coupled to a second node, and the second node is coupled to the input circuit;

a gate of the eighth transistor is coupled to a third node, a first electrode of the eighth transistor is coupled to the third control signal terminal, and a second electrode of the eighth transistor is coupled to a first electrode of the tenth transistor;

a gate of the ninth transistor is coupled to a fourth control signal terminal, a first electrode of the ninth transistor is coupled to the second control signal terminal, and a second electrode of the ninth transistor is coupled to the third node;

a gate of the tenth transistor is coupled to the first control signal terminal, and a second electrode of the tenth transistor is coupled to the second node; and one end of the second capacitor is coupled to the third node, and another end of the second capacitor is coupled to a ground terminal.

13. The pixel circuit according to claim 1, wherein the input circuit includes:

a data writing sub-circuit coupled to a gate signal terminal, a data signal terminal and a first power supply voltage signal terminal, including a driving transistor, wherein the data writing sub-circuit is configured to write a data signal provided by the data signal terminal into a gate of the driving transistor under control of the gate signal terminal, so that the driving transistor outputs the driving signal under control of a gate voltage and a source voltage thereof; and a light-emitting control sub-circuit coupled to the date writing sub-circuit and the time control circuit, and configured to control the light-emitting duration of the element to be driven that is driven by the driving transistor in the data writing sub-circuit according to a signal transmitted by the time control circuit.

14. The pixel circuit according to claim 13, wherein the data writing sub-circuit includes a third transistor, a fifth transistor and a first capacitor, and the third transistor is the driving transistor; a gate of the third transistor is coupled to a first node, and a first electrode of the third transistor is coupled to the first power supply voltage signal terminal; a gate of the fifth transistor is coupled to the gate signal terminal, a first electrode of the fifth transistor is coupled to the data signal terminal, and a second electrode of the fifth transistor is coupled to the first node; one end of the first capacitor is coupled to the first node, and another end of the first capacitor is coupled to the first power supply voltage signal terminal; and the light-emitting control sub-circuit includes a sixth transistor; a gate of the sixth transistor is coupled to the time control circuit, a first electrode of the sixth transistor is coupled to a second electrode of the third transistor, and a second electrode of the sixth transistor is coupled to an anode of the element to be driven.

15. The pixel circuit according to claim 13, wherein the data writing sub-circuit includes: a second transistor, a third transistor, a fifth transistor and a first capacitor, and the third transistor is the driving transistor; a gate of the second transistor is coupled to the gate signal terminal, a first electrode of the second transistor is coupled to a second electrode of the third transistor, and a second electrode of the second transistor is coupled to a first node; a gate of the third transistor is coupled to the first node, and a first electrode of the third transistor is coupled to the first power supply voltage signal terminal; a gate of the fifth transistor is coupled to the gate signal terminal, a first electrode of the fifth transistor is coupled to the data signal terminal, and a second electrode of the fifth transistor is coupled to the first electrode of the third transistor; one end of the first capacitor is coupled to the first node, and another end of the first capacitor is coupled to the first power supply voltage signal terminal; and the light-emitting control sub-circuit includes a sixth transistor; a gate of the sixth transistor is coupled to the time control circuit, a first electrode of the sixth transistor is coupled to the second electrode of the third transistor, and a second electrode of the sixth transistor is coupled to an anode of the element to be driven.

16. The pixel circuit according to claim 15, wherein the light-emitting control sub-circuit further includes a fourth transistor, and the first electrode of the third transistor is coupled to the first power supply voltage signal terminal through the fourth transistor; a gate of the fourth transistor is coupled to a light-emitting control signal terminal, a first electrode of the fourth transistor is coupled to the first power supply voltage signal terminal, and a second electrode of the fourth transistor is coupled to the first electrode of the third transistor.

17. The pixel circuit according to claim 13, wherein the input circuit further includes a reset sub-circuit;— the reset sub-circuit is coupled to a reset signal terminal and an initialization signal terminal, and is configured to reset the driving transistor or reset the driving transistor and the element to be driven through an initialization signal provided by the initialization signal terminal under control of the reset signal terminal; or the reset sub-circuit is coupled to a reset signal terminal, the gate signal terminal and an initialization signal terminal, and is configured to reset the driving transistor under control of the reset signal terminal, and to reset the element to be driven under control of the gate signal terminal.

18. A display device, comprising the pixel circuit according to claim 1.

19. A method for controlling the pixel circuit according to claim 1, the method comprising at least a data writing phase and a light-emitting phase, wherein in the data writing phase, a data signal is written into the input circuit, so that the input circuit outputs the driving signal in the light-emitting phase, and the driving signal is configured to drive an element to be driven to emit light; and in the light-emitting phase, the time control circuit controls the light-emitting duration of the element to be driven to be the first duration by controlling the input circuit in response to the first control signal provided by the first control signal terminal; or in the light-emitting period, the time control circuit controls the light-emitting duration of the element to be driven to be the second duration by controlling the input circuit in response to at least the second control signal provided by the second control signal terminal and the third control signal provided by the third control signal terminal, wherein the third control signal is a square wave signal, the second duration is less than the first duration, and the second duration includes the plurality of interval time periods.

20. The method for controlling the pixel circuit according to claim 19, wherein the time control circuit controls the light-emitting duration of the element to be driven to be the second duration by controlling the input circuit in response to the first control signal, the second control signal and the third control signal; or the time control circuit controls the light-emitting duration of the element to be driven to be the second duration by controlling the input circuit in response to the second control signal, the third control signal and a fourth control signal provided by a fourth control signal terminal.

* * * * *